US008905834B2

(12) United States Patent
Wells

(10) Patent No.: US 8,905,834 B2
(45) Date of Patent: Dec. 9, 2014

(54) TRANSPARENT CARD DISPLAY

(75) Inventor: William R. Wells, Reno, NV (US)

(73) Assignee: IGT, Las Vegas, NV (US)

( * ) Notice: Subject to any disclaimer, the term of this patent is extended or adjusted under 35 U.S.C. 154(b) by 1769 days.

(21) Appl. No.: 11/938,179

(22) Filed: Nov. 9, 2007

(65) Prior Publication Data

US 2009/0124379 A1 May 14, 2009

(51) Int. Cl.
*G07F 17/32* (2006.01)

(52) U.S. Cl.
CPC ..... *G07F 17/32* (2013.01); *G07F 17/3211* (2013.01)
USPC ..... 463/17

(58) Field of Classification Search
CPC ..... G07F 17/322; G07F 17/32
USPC ..... 463/16, 36, 39, 47; 345/175
See application file for complete search history.

(56) References Cited

U.S. PATENT DOCUMENTS

| | | | |
|---|---|---|---|
| 5,586,936 | A | 12/1996 | Bennett et al. |
| 5,651,548 | A | 7/1997 | French et al. |
| 5,707,287 | A | 1/1998 | McCrea et al. |
| 5,735,742 | A | 4/1998 | French et al. |
| 5,743,523 | A | 4/1998 | Kelly et al. |
| 5,772,506 | A | 6/1998 | Marks et al. |
| 5,781,647 | A | 7/1998 | Fishbine et al. |
| 5,788,574 | A | 8/1998 | Ornstein et al. |
| 5,794,964 | A | 8/1998 | Jones et al. |
| 5,795,225 | A | 8/1998 | Jones et al. |
| 5,823,873 | A | 10/1998 | Moody et al. |
| 5,911,626 | A | 6/1999 | McCrea et al. |
| 5,935,002 | A | 8/1999 | Falciglia |
| 5,941,769 | A | 8/1999 | Order |
| 5,957,776 | A | 9/1999 | Hoehne et al. |
| 6,039,650 | A | 3/2000 | Hill et al. |
| 6,056,641 | A | 5/2000 | Webb |

(Continued)

FOREIGN PATENT DOCUMENTS

| | | |
|---|---|---|
| EP | 0 999 517 | 5/2000 |
| EP | 1 936 541 | 6/2008 |
| WO | 2007/030555 | 3/2007 |
| WO | 2007/067213 | 6/2007 |

OTHER PUBLICATIONS

International Search Report and Written Opinion dated Feb. 5, 2009 from PCT/US2008/080771.

*Primary Examiner* — Paul A D'Agostino
(74) *Attorney, Agent, or Firm* — Neal, Gerber & Eisenberg LLP

(57) ABSTRACT

Interactive gaming tables are provided that include one or more video displays. The interactive gaming tables are operable to detect and distinguish between various types of physical objects placed on the interactive gaming table, associate a function with at least one type of physical object and generate a video display window on a video display that is viewable through a transparent portion of the one type of physical object. Video images including content associated with the function can be provided in the video display window. The interactive gaming tables can be used to provide a wager-based table game where the function associated with one of the physical objects can be a function related to play of the wager-based table game or a function related to a particular player playing the wager-based game. A mostly transparent, credit-card sized object designed to be carried by a game player is one example of one type of physical object that can be utilized with the interactive gaming table.

20 Claims, 8 Drawing Sheets

(56) References Cited

U.S. PATENT DOCUMENTS

| | | | | |
|---|---|---|---|---|
| 6,110,041 | A | 8/2000 | Walker et al. | |
| 6,117,012 | A | 9/2000 | McCrea et al. | |
| 6,165,069 | A | 12/2000 | Sines et al. | |
| 6,267,671 | B1 | 7/2001 | Hogan | |
| 6,299,536 | B1 | 10/2001 | Hill | |
| 6,313,871 | B1 | 11/2001 | Schubert | |
| 6,346,044 | B1 | 2/2002 | McCrea, Jr. | |
| 6,460,848 | B1 | 10/2002 | Soltys et al. | |
| 6,511,068 | B1 | 1/2003 | Sklansky et al. | |
| 6,514,140 | B1 | 2/2003 | Storch | |
| 6,517,073 | B1 | 2/2003 | Vancura | |
| 6,517,435 | B2 | 2/2003 | Soltys et al. | |
| 6,530,837 | B2 | 3/2003 | Soltys et al. | |
| 6,533,276 | B2 | 3/2003 | Soltys et al. | |
| 6,533,662 | B2 | 3/2003 | Soltys et al. | |
| 6,579,180 | B2 | 6/2003 | Soltys et al. | |
| 6,607,195 | B2 | 8/2003 | Vancura | |
| 6,758,751 | B2 | 7/2004 | Soltys et al. | |
| 6,848,994 | B1 | 2/2005 | Knust et al. | |
| 6,884,168 | B2 | 4/2005 | Wood et al. | |
| 6,923,446 | B2 | 8/2005 | Snow | |
| 7,011,309 | B2 | 3/2006 | Soltys et al. | |
| 7,017,805 | B2 | 3/2006 | Meehan | |
| 7,018,291 | B1 | 3/2006 | Lemke et al. | |
| 7,108,606 | B1 | 9/2006 | Luciano | |
| 7,114,718 | B2 | 10/2006 | Grauzer et al. | |
| 7,267,614 | B1 | 9/2007 | Jorasch et al. | |
| 7,549,920 | B2 | 6/2009 | Jorasch et al. | |
| 7,878,896 | B2 | 2/2011 | Jorasch et al. | |
| 8,029,357 | B2 | 10/2011 | Jorasch et al. | |
| 8,118,669 | B2 | 2/2012 | Rader et al. | |
| 2002/0042298 | A1 | 4/2002 | Soltys et al. | |
| 2002/0042299 | A1 | 4/2002 | Soltys et al. | |
| 2002/0068625 | A1 | 6/2002 | Soltys et al. | |
| 2002/0072406 | A1 | 6/2002 | Soltys et al. | |
| 2002/0072407 | A1 | 6/2002 | Soltys et al. | |
| 2002/0094855 | A1 | 7/2002 | Berman | |
| 2002/0177480 | A1 | 11/2002 | Rowe | |
| 2003/0087696 | A1 | 5/2003 | Soltys et al. | |
| 2003/0171142 | A1 | 9/2003 | Kaji et al. | |
| 2004/0056418 | A1 | 3/2004 | Wirth | |
| 2004/0056419 | A1 | 3/2004 | Wirth | |
| 2004/0251630 | A1 | 12/2004 | Sines et al. | |
| 2005/0026680 | A1 | 2/2005 | Gururajan | |
| 2005/0026683 | A1 | 2/2005 | Fujimoto | |
| 2005/0054408 | A1 | 3/2005 | Steil et al. | |
| 2005/0119048 | A1 | 6/2005 | Soltys et al. | |
| 2005/0248729 | A1 | 11/2005 | Drucker et al. | |
| 2005/0277463 | A1 | 12/2005 | Knust et al. | |
| 2005/0282622 | A1 | 12/2005 | Lindquist | |
| 2006/0001211 | A1 | 1/2006 | Lewis et al. | |
| 2006/0019739 | A1 | 1/2006 | Soltys | |
| 2006/0027970 | A1 | 2/2006 | Kyrychenko | |
| 2006/0036944 | A1 | 2/2006 | Wilson | |
| 2006/0058082 | A1 | 3/2006 | Crawford et al. | |
| 2006/0058083 | A1 | 3/2006 | Crawford et al. | |
| 2006/0058084 | A1 | 3/2006 | Crawford et al. | |
| 2006/0058085 | A1 | 3/2006 | White et al. | |
| 2006/0058086 | A1 | 3/2006 | White et al. | |
| 2006/0058087 | A1 | 3/2006 | White et al. | |
| 2006/0058088 | A1 | 3/2006 | Crawford et al. | |
| 2006/0058089 | A1 | 3/2006 | White et al. | |
| 2006/0058090 | A1 | 3/2006 | Crawford et al. | |
| 2006/0058091 | A1 | 3/2006 | Crawford et al. | |
| 2006/0058092 | A1 | 3/2006 | Crawford et al. | |
| 2006/0058093 | A1 | 3/2006 | White et al. | |
| 2006/0066052 | A1 | 3/2006 | White et al. | |
| 2006/0066564 | A1 | 3/2006 | Yee et al. | |
| 2006/0068864 | A1 | 3/2006 | White et al. | |
| 2006/0068865 | A1 | 3/2006 | White et al. | |
| 2006/0068866 | A1 | 3/2006 | White et al. | |
| 2006/0068868 | A1 | 3/2006 | Crawford et al. | |
| 2006/0068869 | A1 | 3/2006 | White et al. | |
| 2006/0068870 | A1 | 3/2006 | Crawford et al. | |
| 2006/0068871 | A1 | 3/2006 | Crawford et al. | |
| 2006/0068879 | A1 | 3/2006 | Crawford et al. | |
| 2006/0068899 | A1 | 3/2006 | White et al. | |
| 2006/0092170 | A1* | 5/2006 | Bathiche et al. | 345/589 |
| 2006/0128462 | A1 | 6/2006 | Jorasch et al. | |
| 2006/0160600 | A1 | 7/2006 | Hill et al. | |
| 2006/0160608 | A1 | 7/2006 | Hill et al. | |
| 2006/0165254 | A1 | 7/2006 | Fujimoto et al. | |
| 2006/0177109 | A1 | 8/2006 | Storch | |
| 2006/0202422 | A1 | 9/2006 | Bahar | |
| 2006/0223638 | A1 | 10/2006 | Koyama et al. | |
| 2006/0252521 | A1 | 11/2006 | Gururajan et al. | |
| 2006/0252554 | A1 | 11/2006 | Gururajan et al. | |
| 2006/0258427 | A1 | 11/2006 | Rowe et al. | |
| 2006/0258442 | A1 | 11/2006 | Ryan | |
| 2006/0264252 | A1 | 11/2006 | White et al. | |
| 2006/0277100 | A1 | 12/2006 | Parham | |
| 2006/0287066 | A1 | 12/2006 | Crawford et al. | |
| 2006/0287067 | A1 | 12/2006 | White et al. | |
| 2006/0287101 | A1 | 12/2006 | Crawford et al. | |
| 2006/0287102 | A1 | 12/2006 | White et al. | |
| 2006/0287103 | A1 | 12/2006 | Crawford et al. | |
| 2006/0287104 | A1 | 12/2006 | White et al. | |
| 2006/0293099 | A1 | 12/2006 | Cooper | |
| 2007/0015574 | A1 | 1/2007 | Vale et al. | |
| 2007/0045957 | A1 | 3/2007 | Blair | |
| 2007/0045958 | A1 | 3/2007 | Rader et al. | |
| 2007/0066388 | A1 | 3/2007 | Storch | |
| 2007/0077987 | A1 | 4/2007 | Gururajan | |
| 2007/0188444 | A1 | 8/2007 | Vale et al. | |
| 2007/0201863 | A1 | 8/2007 | Wilson et al. | |
| 2007/0211921 | A1 | 9/2007 | Popp et al. | |
| 2007/0293309 | A1 | 12/2007 | Jorasch et al. | |
| 2007/0293311 | A1 | 12/2007 | Walker et al. | |
| 2008/0188292 | A1 | 8/2008 | Walker et al. | |
| 2009/0115133 | A1* | 5/2009 | Kelly et al. | 273/274 |
| 2009/0121431 | A1 | 5/2009 | Rader et al. | |
| 2009/0121432 | A1 | 5/2009 | Rader et al. | |
| 2009/0124377 | A1 | 5/2009 | Rader et al. | |
| 2010/0130280 | A1* | 5/2010 | Arezina et al. | 463/20 |

* cited by examiner

TRANSPARENT CARD DISPLAY

TECHNICAL FIELD

The present invention relates generally to display methods within a gaming environment, and more specifically to gaming tables with integrated physical object recognition and display capabilities.

BACKGROUND

Casinos and other forms of gaming comprise a growing multi-billion dollar industry both domestically and abroad, with table games continuing to be an immensely popular form of gaming and a substantial source of revenue for gaming operators. Such table games are well known and can include, for example, poker, blackjack, baccarat, craps, roulette and other traditional standbys, as well as other more recently introduced games such as pai-gow, Caribbean Stud, Spanish 21, and Let It Ride, among others. Under a typical gaming event at a gaming table, a player places a wager on a game, whereupon a winning may be paid to the player depending on the outcome of the game. As is generally known, a wager may involve the use of cash or one or more chips, markers or the like, as well as various forms of gestures or oral claims. The game itself may involve the use of, for example, one or more cards, dice, wheels, balls, tokens or the like, with the rules of the game and any payouts or pay tables being established prior to game play. As is also known, possible winnings may be paid in cash, credit, one or more chips, markers, or prizes, or by other forms of payouts. In addition to table games, other games within a casino or other gaming environment are also widely known. For instance, keno, bingo, sports books, and ticket drawings, among others, are all examples of wager-based games and other events that patrons may partake of within a casino or other gaming establishment.

Although standard fully manual gaming tables have been around for many years, gaming tables having more "intelligent" features are becoming increasingly popular. For example, many gaming tables now have automatic card shufflers, LCD screens, biometric identifiers, automated chip tracking devices, and even cameras adapted to track chips and/or playing cards, among various other items and devices. Many items and descriptions of gaming tables having such added items and devices can be found at, for example, U.S. Pat. Nos. D512,466; 5,613,912; 5,651,548; 5,735,742; 5,781,647; 5,957,776; 6,165,069; 6,179,291; 6,270,404; 6,299,534; 6,313,871; 6,532,297; 6,582,301; 6,651,985; 6,722,974; 6,745,887; 6,848,994; and 7,018,291, as well as U.S. Patent Application Publication Nos. 2002/0169021; 2002/0068635; 2005/0026680; 2005/0137005; and 20060058084, each of which is incorporated herein by reference, among many other varied references.

Such added items and devices certainly can add many desirable functions and features to a gaming table, although there are currently limits as to what may be accomplished. For example, many gaming table items and devices are designed to provide a benefit to the casino or gaming establishment, and are not particularly useful to a player and/or player friendly. Little to no player excitement or interest is derived from such items and devices. Thus, while existing systems and methods for providing gaming tables and hosting table games at such gaming tables have been adequate in the past, improvements are usually welcomed and encouraged. In light of the foregoing, it is desirable to provide a more interactive gaming table.

SUMMARY

It is an advantage of the present invention to provide gaming tables, in a gaming environment adapted to host wager based games that include coordinated object recognition and display techniques. According to several embodiments of the present invention, the disclosed devices, systems and methods include an interactive gaming table adapted for hosting table gaming events involving accepting wagers, playing table games based on the wagers and granting monetary awards based on the results of the table games. The interactive gaming table may include a first surface adapted for the play of one or more wager-based table games and an outer circumference adapted for the presence of one or more active players at the interactive gaming table.

The first surface adapted for the play of the one or more wager-based table games may comprise a plurality of video display areas operable to display video images. The video images in the video display areas may be generated using one or more of 1) display devices coupled to the first surface such that an outer portion of the display device forms a portion of the first surface, 2) display devices configured to project a video image on the top of the first surface or 3) display devices configured to display an image on the first surface from beneath the first surface. In particular embodiments, a single display device may provide video images for a portion of a single video display area, a single video display area or multiple video display areas.

The interactive gaming table may include an object detection system that enables a position, a shape, an orientation or combinations of a physical object placed on the first surface adapted for the play of the one or more wager-based table games to be determined. In response to detecting a physical object placed on the first surface, the interactive gaming table may be operable to open a video display window at a particular location in one of the video display areas of the interactive gaming table. In a particular embodiment, the physical object may include a transparent portion that allows information displayed in a video display window opened below the transparent object to be viewed through the physical object.

One aspect of the prevent invention is a method of providing a wager-based game involving granting monetary awards based on the results of the wager-based game at an interactive gaming table. The method may comprise providing the interactive gaming table where the interactive gaming table may include but is not limited to 1) a first surface adapted for a play of the wager-based game where the interactive gaming table may be operable to allow one or more active players to play the wager-based game on the first surface, 2) a plurality of video display areas on the first surface wherein at least one video display area is associated with each active player, 3) an object detection system operable to determine one of a position, a shape, an orientation or combinations thereof of one or more physical objects placed on the first surface and 4) a master gaming table controller coupled to the plurality of video display areas and coupled to the object detection system operable to control the play of the wager-based for the one or more active players.

The method utilizing the interactive game table may comprise 1) initiating in the master gaming table controller the wager-based game for at least a first active player; 2) receiving in the master gaming table controller information from the object detection system indicating a first physical object is located in a first video display area associated with the first active player where the first physical object includes a transparent portion that allows information generated in the first video display area to be viewed through the transparent portion; 3) determining in the master gaming controller one of a position, a shape, an orientation or combinations thereof of the transparent portion in the first video display area, 4) determining in the master gaming table controller one of a position, a shape, an orientation or combinations thereof of a first video display window in the first video display area to allow information generated in the first video display window to be viewable through the transparent portion of the first physical object; 5) controlling in the master gaming controller a display of first video images in the first video display window where the first video images may include information associated with the first active player; 6) controlling in the master gaming controller a display of second video images of including information related to the play the wager-based game in the first video display area; and 7) determining in the master gaming controller the results of the wager-based game for the first active player.

In particular embodiments, the first physical object may be moved during game play, such as during a single wager-based game or from a first position/orientation in a first play of the wager-based game to a second position/orientation in a second play of the wager-based game. The position/orientation of the first physical object may be altered by a game player or a game operator, such as a dealer. Thus, the method may also comprise during the play of the wager-based game, determining in the master gaming controller one of a second position and a second orientation of the transparent portion in the first video display area and determining in the master gaming table controller one of a second position and a second orientation of the first video display window in the first video display area to allow information generated in the first video display window to be viewable through the transparent portion of the first physical object.

In particular embodiments, the second video images may include one or more game objects. The one or more game objects may also be displayed in the first video window and may include but are not limited to a chip, a marker, a die, a playing card or a marked tile. In general, the game objects may comprise any game piece associated with the play of wager-based table game. The game pieces may appear to be 3-D dimensional in the rendered video images.

When placed on the first surface, a footprint of the first physical object on the first surface may be one of a rectangular shaped or a circular shaped. In general, the foot print of the first physical object may be any shape. The foot print of the first physical object may be determined using the object detection system.

The method may further comprise determining in the master table gaming controller an identity of the first active player and displaying in the first video display window player tracking information associated with the first active player. The identity of the first active player may be determined using information obtained from the first physical object. In particular embodiments, the information obtained from the first physical object may be marked or written on the first physical object and read using a suitable detection device or the information may be stored in a memory on first physical object, such as with an RFID tag and read using a suitable reading device.

In another embodiment, the method may further comprise, 1) determining in the master table gaming controller the information displayed in the first video display window includes critical game information, 2) storing to a power-hit tolerant non-volatile memory the critical game information, the position, the shape, the orientation or the combinations thereof of the first video display window and information regarding one or more physical objects, such as but not limited to there locations and orientation on the first surface, 3) receiving in the master table gaming controller a request to display the critical game information previously displayed in the first video display window; 4) retrieving from the power-hit tolerant non-volatile memory the critical game information and the position, the shape, the orientation or the combinations thereof of the first video display window; 5) controlling in the master table gaming controller the display of the critical game information in the first video display window using the position, the shape, the orientation or the combinations thereof retrieved from the power-hit tolerant non-volatile memory and 6) providing information regarding the one or more physical objects, such that there placement and location on the first surface may be recreated when the one or more physical objects are available.

In yet other embodiments, the method may comprise 1) providing the first physical object wherein the first physical object includes a first display; 2) selecting in the master gaming controller information to display to the first active player, 3) generating in the master gaming controller video images including the information selected for the first active player in the first video display window; 4) sending from the master gaming controller to the first physical object the information selected for first active player to allow the information selected for the first active player to be displayed at the same time on the first display and the first video display window. The information selected for the first active player may be an award, promotional credits or an offer.

The first physical object may comprise transparent, non-transparent and translucent portions. The size and shape of each transparent portion may vary from transparent portion to transparent portion. When the first physical object includes a first transparent portion and a second transparent portion and method may further comprise: controlling in the master table gaming controller a display of first video images visible through the first transparent portion and a display of second video images visible through the second transparent portion. For instance, the first physical object may include two card-shaped transparent portions and the master table gaming controller may be operable to display a separate playing card that is viewable through each of the card-shaped transparent portions of the first physical object.

One or more of the transparent portions or non-transparent portions of the first physical object may include a dynamically adjustable display, such as an LCD, an OLED (Organic Light Emitting Display), a FOLED (Flexible Organic Light Emitting Display), a TOLED (Transparent Organic Light Emitting Display), an EPD (ElectroPhoretic display) or other suitable display. The display on the first physical object may or may not be a color display. The method may further comprise sending from the master gaming controller to the first physical object commands, data or instructions that are used by the first physical object to display information to its display.

The light-transmissive properties of the first physical object may be dynamically adjustable. For instance, a transparent portion may be changed from transparent to opaque and back to transparent to reveal or hide information viewed through the transparent portion. The method may further comprise sending from the master gaming controller to the first physical object a command for the first physical object to adjust is light-transmissive properties. In further embodiments, the first physical object may include one or more sensors, such as a touch pad sensor. Further, the physical object may include one or more emitters, such as an RFID tag or a light source emitter, such as a visible or infrared light emitter.

In other embodiments, the method may further comprise 1) controlling in the master gaming controller a display of first video images including a touch activated button in the first display window that is viewable through the transparent portion of the first physical object; 2) receiving in the master gaming controller information indicating a selection of the touch activated button; and 3) in response to the selection of touch activated button, controlling in the master gaming controller a display of second video images.

The method may further comprise: 1) determining in the master table gaming controller the first physical object is not located within an acceptable area of the first video display area; 2) controlling in the master table gaming controller a display of video images in the first video display area indicating the first physical object is not within the acceptable area; 3) halting the play of the wager-based game; 4) determining in the master table gaming controller the first physical object is within the acceptable area of the first video display area; and 5) continuing the play of the wager-based game.

The interactive gaming table may comprise one or more components, such as cameras and/or sensors, configured to determine a position and orientation of an object placed on the first surface of the interactive gaming table, such as a location and orientation of the object within a particular display region. The position and orientation of the object placed on the table may influence a position and orientation of information displayed in a display region. In a particular embodiment, a transparent or translucent object may be placed on the first surface of the interactive gaming table, the position/orientation of the object may be detected and in response, a characteristic of a portion of a display residing under the object may be altered.

Added electronic devices can include a plurality of slave controller devices adapted to facilitate various table activities at the different active player positions, with each of the active player positions including at least one dedicated said slave controller device. Also provided can be a master gaming table controller in communication with each of the slave controller devices, with such a master controller being adapted to control a plurality of interactive gaming table functions, and also adapted to synchronize communications and activities between the slave controller devices. One or more access interfaces can be provided, with such access interfaces being in communication with said master gaming table controller and adapted for communications with one or more networked devices located away from the interactive gaming table. Such access interfaces may be adapted for wireless communications. One or more gaming table tracking devices can also be provided in communication with the master gaming table controller and adapted to facilitate the tracking of one or more gaming events or transactions at the interactive gaming table. These gaming table tracking devices may be incorporated into an object detection system. Such table tracking devices can include cameras, radio frequency identification ("RFID") chips, antenna, infrared light emitters, infrared cameras machine vision systems and/or other suitable tracking devices.

In various embodiments of the present invention, which may include some or all of the foregoing elements, an interactive table gaming system is provided. Such a system can include a plurality of interactive gaming tables such as those described above, as well as an interactive gaming table host server located remotely from one or more of the gaming tables and in direct or indirect communication with each of the interactive gaming tables. Such a host server can be adapted to synchronize coordinated gaming activities between at least two of the interactive gaming tables, with such activities including table game tournaments, networked table game bonuses and other networked gaming events. Communications can be had between the host server and various interactive gaming tables, as well as between interactive gaming tables themselves. Of course, added network communications can include those between gaming tables and various auxiliary devices, such as player controlled betting or back betting devices.

In various further embodiments, methods of providing a networked gaming event at such an interactive gaming table are provided. Pertinent method steps can include providing a first interactive gaming table such as that disclosed above, establishing a communication connection between said at least one access interface at the interactive gaming table and a first networked device, sending instructions to a master gaming table controller at the table from such a first networked device via the established communication connection, presenting a gaming event at the interactive gaming table based at least in part on those sent instructions, awarding a prize or monetary payout to an active player at the interactive gaming table based on that gaming event, collecting automatically game event information from the play of table games at the interactive gaming table, establishing a second communication connection between an access interface at the interactive gaming table and a second networked device, and forwarding the collected game event information to the second networked device.

Such access interface or interfaces can be wireless, and networked devices can include a remotely located interactive gaming table host server, other interactive gaming table(s), and/or handheld wireless device(s). The sent instructions can include instructions for changing a display atop the gaming table playing surface from a first gaming formatted layout to a second different formatted gaming layout, with a further method step being to then change the display atop the first playing surface from the first gaming formatted layout to the second different formatted gaming layout, such that a different table game can be played at the interactive gaming table. In some embodiments, such instructions or other communications can be sent from the host server to a second interactive gaming table, which then relays the instructions or other communications to the first interactive gaming table.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive progressive bonusing systems and methods for table games. These drawings in no way limit any changes in form and detail that may be made to the invention by one skilled in the art without departing from the spirit and scope of the invention.

DETAILED DESCRIPTION

Figure 1A:
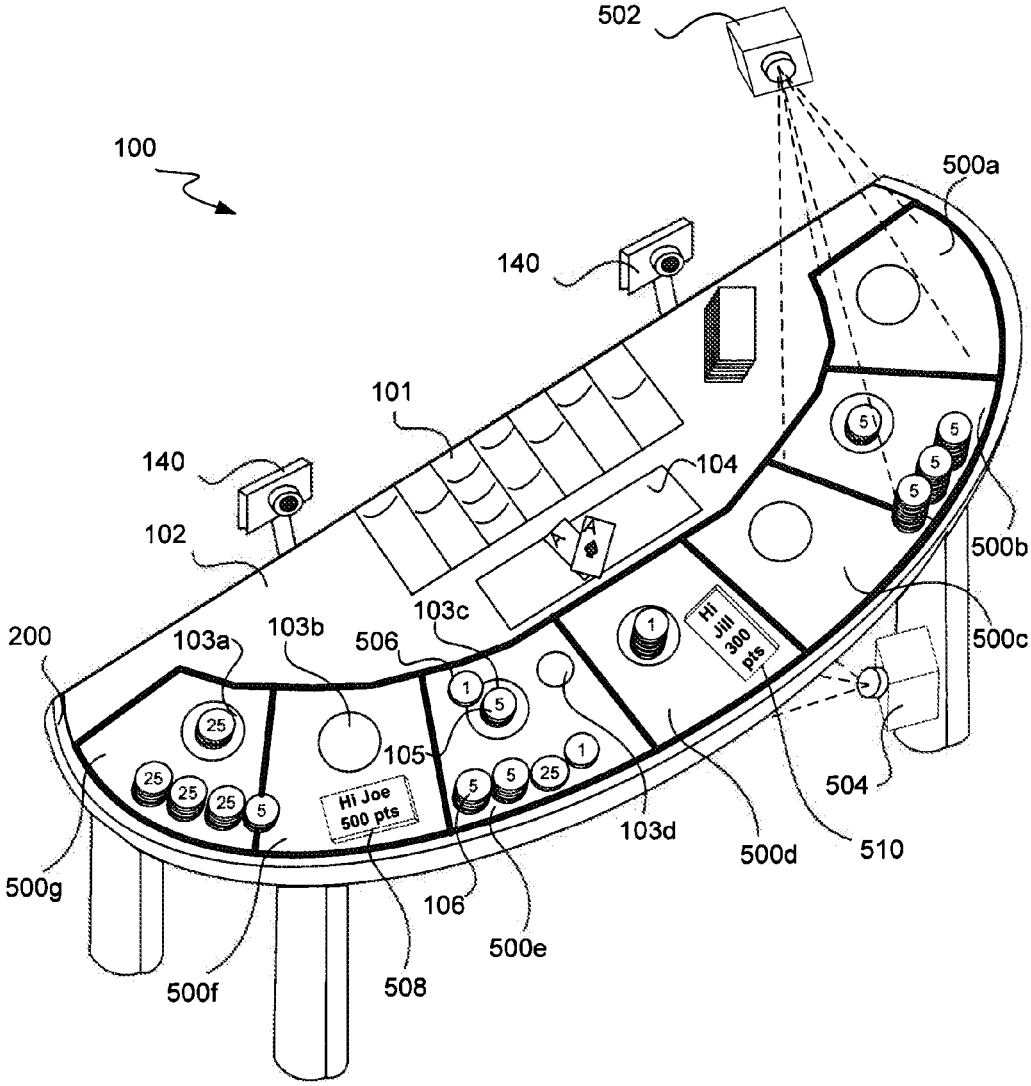
FIGS. 1A-1B illustrates in top perspective view an exemplary interactive gaming table according to one embodiment of the present invention.

Exemplary applications of systems and methods according to the present invention are described in this section. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following example should not be taken as definitive or limiting either in scope or setting. In the detailed description that follows, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

Various advantages of the present invention include the introduction of an interactive gaming table that is more fully automated, providing added benefits to the gaming operator, and also having various automated and player friendly items and functionalities. Also provided an interactive gaming table network adapted to provide interconnected table game activities and events, such that pit, casino, or area wide table game tournaments, bonuses and the like can be provided. The interactive gaming table may be utilized by one or more players to play wager-based table games.

The foregoing and many other aspects of the present invention may be accomplished at least in part by providing various peripherals at the interactive gaming table, one or more display devices and an object detection system that allows objects placed on a surface (e.g., a horizontal surface where gaming activities are provided) of the interactive gaming table to be detected. The display devices may provide video images that are visible on the surface. In some embodiments, one or more slave controllers adapted to manage discrete player positions or stations, a master table gaming controller adapted to synchronize activities between the slave controllers and administer a variety of global interactive gaming table functions, and one or more network access interfaces, such as wireless interfaces, to enable the interactive gaming tables to communicate with each other and various other outside servers and devices may be provided.

When certain physical objects are detected by the object detection system, the interactive gaming table may be operable to alter the video images that are visible on the surface of interactive gaming table where gaming activities are provided. The precise manner in which the video images are altered may depend on one or more physical characteristics of the physical object as well as information acquired from the physical object. Thus, when the video images are altered in response to detecting a physical object, the alterations may vary depending on the physical object that is detected. Further, all of the physical objects that may be utilized at an interactive gaming table may trigger an alteration of the video images that may be displayed at the interactive gaming table. Thus, the interactive gaming table in conjunction with the object detection system may be operable to distinguish between different physical object that trigger and don't trigger an alteration of the video images that may be generated at the interactive gaming table. The apparatus and method associated with altering video images in response to detecting a physical object at the interactive gaming table may be referred to coordinated object detection and video display capabilities.

The remainder of this detailed description shall continue with the description of an interactive gaming table with coordinated object detection and video display capabilities according to various embodiments of the present invention. In particular, wager-based game play on an interactive game table including objection detection and video image display in response to the object detection is described with respect to FIGS. 1A-D, 2A-B and 3. Various embodiments for a network involving a plurality of interconnected interactive gaming tables are then described with respect to FIG. 4. Next, an exemplary method of providing a gaming event across a plurality of networked interactive gaming tables is described with respect to FIG. 5. Finally, an exemplary method of storing and retrieving a game history record of a wager-based table game on an interactive gaming table including coordinated object detection is described with respect to FIG. 6.

Interactive Gaming Table

Referring first to FIG. 1A, an exemplary interactive gaming table 100 is shown in top perspective view. While interactive gaming table 100 can include multiple automated peripheral devices, items and features that might typically be found on a slot machine, video poker machine or other similar gaming machine, it will be understood that FIG. 1A is being provided solely for illustrative purposes, such that many such added peripherals are not shown in this general overview.

The interactive gaming table 100 may include coordinated object detection and video image display capabilities. In particular, the interactive gaming table 100 may be operable to detect the presence of a class of physical objects placed on surface 102 that are distinguishable from other physical objects that may be placed on the surface 102. In response to detecting a presence of a first physical object in the class of physical objects, the interactive game table may be operable to alter in some way video images that are displayed on surface 102 of the interactive gaming table 100.

As an example of coordinated object detection and video image display capabilities, the interactive gaming table 100 may be operable to generate video images within and/or around chip placement areas 103*a-c*. When the presence of a chip is detected within or touching one of the chip placement areas then a characteristic of the video images within or around chip placement areas 103*a-c* may be altered. In further detail, the chips may be transparent or opaque, such that a portion of a video image generated below the chips may be viewed through the chip or the chip may block a portion of the video image beneath it.

In one embodiment, the chip 506 may be transparent and the number "1" associated with chip 506 may be a portion of a video image that is generated below the chip while gaming chip(s) 105 may be opaque and block a video image rendered below it. The interactive gaming table 100 may be operable to move operable to move the portion of the video image with the "1" underneath chip 506 to a different location in the video image when chip 506 is moved to a different location, such as to another location touching the circle defining the chip placement area 103*c*. Thus, the interactive gaming table 100 may be operable to detect a placement and location of chip 506, which is transparent, on surface 102 and in response alter a video image that viewable through chip 506.

The interactive gaming table 100 may also be operable to detect gaming chip(s) 105, which may be opaque and may block the transmission of video images, such that when the chip 105 is first placed in the chip placement area 103*c* a video image rendered below chip 105 may be altered. After the first placement of chip 105 in the chip placement area 103*c*, if chip 105 is moved within a circle defining chip placement area 103*c*, the video image may not be altered. However, if chip 105 is removed from the chip placement area 103*c*, then the video images may be altered again. Thus, in some embodiments, an ability of an object to alter video images displayed at the interactive gaming table 100 may depend on its position, which may be within an area on the surface, the object first being detected within the area and the object being removed from the area, whereas, the object being moved within the area doesn't alter the video images. In other embodiments, as will be described as follows, each time a physical object is moved, it may trigger an alteration of video images generated at the interactive gaming table.

Further to this example, the interactive gaming table may be operable to detect the presence of chips 106 at the edge of the outer circumference of the interactive gaming table 100 but the presence of chips or placement of chips in this area may not affect the content of any video images generated by the interactive gaming table 100. Thus, in some embodiments, an ability of an object to alter the video images displayed at the interactive gaming table 100 may depend on its location on the surface of the interactive gaming table.

Further expanding this example, in some instances, the placement of a physical object on a surface of the interactive gaming table, may not have a nominal effect on the video images no matter where it is placed. For example, the object system may not recognize the object. Nevertheless, an unrecognized object may have a non-nominal effect in the sense, the object system may determine that an unrecognized object is located in area unacceptable area, such as a player placing a glass in chip placement area 103*a*, and generate a message which alters the video images indicating an error of some type.

Yet further expanding this example, in other instances, the placement of a first physical object may trigger a first alteration of the video images when it is detected at a first position on the surface 102 of the interactive game table 100 and the placement of the first physical object may trigger a second alteration of the video images when it is detected at a second alteration of the video images when it is placed at a second position on the surface 102. For example, the surface may include the chip placement area 103*c*, which may be for primary wagers on a table game being played, and a second chip placement area 103*d*, which may be for secondary wagers. When chip 105 is placed in chip placement area 103*c*, video images may be triggered that indicate a primary wager has been made. When chip 105 is placed in chip placement area 103*d*, video images may be triggered that indicate a secondary wager has been made.

Further expanding this example, a value may be associated with each of a plurality of transparent chips. The interactive gaming table 100 may be operable to detect that a plurality of transparent chips are stacked and add the value of the chips stacked together. Then, the interactive gaming table may generate a video image of a value of the stack that is viewable through stack of transparent chip. If additional chips are added or removed from the stack, then the interactive gaming table may be operable to adjust the value of the stack of chips that is viewable through stack of chips or another embodiment is projected on top of the stack of chips.

In another example, the interactive gaming table 100 may be operable to display video images in the area where rectangular objects 508 or 510 are placed. In a particular embodiment, the rectangular objects 508 and 510 may comprise a transparent material such that a video image generated beneath either of the objects may be viewed through the physical objects by a person looking down at the surface 102. In another embodiment, the physical objects may comprise a material that is suitable for video projection, such that a video image projected on top of one of the physical objects may be viewed easily by a player looking down on the video objects.

In FIG. 1A, first video images with textual information comprising the messages "Hi Joe" and "500 pts" may be visible on top of or visible through object 508 and second video images with textual information comprising the messages "Hi Jill" and "300 pts" may be visible on top of or visible through object 510. The names Joe and Jill may correspond to the names of two players that are participating in wager-based table game at interactive gaming table 100. The points may be associated with a bonus game or tournament game that each of the players are playing or may be associated with player tracking points that the players are earning or have earned.

In a particular embodiment, the physical objects 508 and 510 may be of a similar size, such as credit card-sized objects which may be carried by a game player. This type of physical object may also be utilized by an operator of the interactive gaming table. The interactive gaming table 100 may be operable to detect an orientation of each object (as well as a location and a shape) and then determine an orientation to generate video images including textual information that are visible through the objects. In FIG. 1A, for object 508, the video images including textual information are rendered such that the text is parallel to the longer dimension of the rectangular. For object 510, the video images including textual information are rendered such that the text is parallel to shorter dimension of the rectangular.

In another embodiment, the interactive gaming table may "anchor" video images to a particular location on an object. For example, for object 510, short side of the rectangle near "Hi" may be considered a top of a video display window and the parallel side opposite the top side may be considered a bottom of a video display window where the length of the short side of the rectangle is the width of the video display window for the purposes of generating video images below object 510. The interactive gaming table 100 may be operable to always render text from the top of the object 510 to the bottom object 510 independent of the object's orientation such that the text may rotate as object 510 is rotated such that the text is always parallel to the line forming the top side of the object 510. Thus, when object 510 is rotated approximately 180 degrees, the text rendered in a video display window below the object 510 may appear upside down to a player. In another example, the "1" rendered in a video image below object 506 may be anchored such that as the chip is rotated around an axis through its center, the "1" projected below the chip may also rotate.

In other embodiments, the ability to detect a placement and change in orientation of an object placed on surface 102 of the interactive gaming table may be utilized to simulate a rotating object, such as a bonus wheel, on the interactive table 100. For example, in various embodiments, a thin object with a bump at its center of mass to provide a rotation point, such as but not limited to a clear circular disk with a small bump at its center of mass, a clear triangular shaped disk with a bump at its center of mass or a balanced thin arrow-shaped object with a bump at its center of mass, may be placed on interactive gaming table 100 and set into a rotating motion. The interactive gaming table 100 may be operable to detect the presence of any of these objects and their rotation rate and then generate video images below the around the objects, such as images of a segmented wheel including various indicia that appear to rotate below the clear disk or images of various indicia near the tip of the arrow. This type of object detection and video image coordinate may be used to provide a bonus to a player. In this example, the center of mass of the object may remain in proximately the same position, and the change in orientation of the physical object, i.e., its rotational motion may alter the video images generated at the interactive gaming table, which in this example, may be viewable through the rotating object.

As noted above, the size of video display window opened in response to detecting an object doesn't have to fit within the object. Referring to the spinning wheel above, the size of video wheel may be much larger than the spinning objects to allow multiple players seated at a large interactive gaming table to see the wheel spinning. In this example, the physical spinning wheel may be located in the center of a much larger video image of a spinning wheel. Further, the video display window doesn't have to be centered with respect to the physical object. For example, a spinning wheel shaped object as described above may trigger a video image of a larger wheel shaped object that is located below the actual physical spinning object but may emulate some of the physical characteristics of the physically spinning wheel. In general, a video display window that is triggered in response to detection of a physical object may overlap with a position of the object on a surface of the interactive gaming table or may not overlap.

In another embodiment, a detection of a physical object may trigger an opening of multiple video display windows. For example, a physical object utilized by an operator may trigger an opening of video display windows at a plurality of locations on the surface of the interactive gaming table. For instance, when the bonus wheel is utilized in the example described above, one wheel shaped video display window may be instantiated and then rectangular video display windows may be opened at a plurality of locations where different players are seated around the interactive gaming table. The rectangular video display may be utilized to allow each player to more easily see information that is associated with the spinning wheel, such as a bonus. Further, the individual windows may provide information that is particular to each player. For example, a bonus game utilizing the spinning wheel may depend on a side wager amount made by each player and thus, the information, such as award information may vary from player to player.

In general, the shape of the physical objects may be relatively flat, e.g., like a credit card, as described above, or may include significant thickness. The shape of the object in each dimension is completely variable and is not limited to the examples described herein. In various embodiments, one or more functions of a physical object may be associated with a physical characteristic, such as its shape, a physical dimension (e.g., thickness), a color, marking on the object or a combination thereof, such that when the physical characteristic or combination of physical characteristics is detected, a video display window providing the one or more functions is instantiated. The one or more functions may be provided utilizing a video display window alone or in combination with other peripheral devices coupled to the interactive gaming table.

In yet other embodiments, a group of class of objects may be related to one or more functions provided at the interactive gaming table based upon only aspects of its geometric properties. As examples, hexagon shaped objects may be associated with operator functions, such as game play, clear flat rectangular objects of a particular length and width may be associated with maintenance functions, such as table diagnostics, whereas oval shaped objects of a particular thickness may be associated with regulator functions. Obviously, these examples are provided for illustrative purposes only as types of physical objects with various geometric properties are essentially endless.

In the following paragraphs, additional details regarding coordinated object detection and video display capabilities, such as object detection method and apparatus and components of the interactive gaming table 100, as well as general uses of the interactive gaming table 100 are described with respect to FIGS. 1A-1D.

Although interactive gaming table 100 has the general appearance of a blackjack table or a gaming table for a similarly distributed and played main table game, it will be readily appreciated that the gaming tables used in conjunction with the present invention can also be extended to other forms of gaming tables and even alternative gaming venues. For example, the gaming table may be square or rectangular, with a square or a rectangular video display area provided within the center. Player and/or operator positions may be orientated around each side of the square or rectangular.

As may be readily appreciated, the interactive gaming table 100 depicted may be particularly adapted to host any of a number of standard casino table games, such as blackjack, baccarat, pai-gow, Caribbean Stud, Spanish 21, and Let It Ride, among others. Similar interactive gaming tables can be created with layouts as may be applicable for different types of gaming tables or alternative venues, such as, for example, a craps table layout, a roulette table layout, and/or a sports book counter or presentation, among other suitable gaming tables or venues. The layout, in whole or in part, for various games that may be played on the interactive gaming table 100, may be generated using the video display capabilities of the interactive gaming table.

In particular embodiments, the interactive gaming table may comprise a plurality of video display areas 500*a-f*. In the video display areas, 500*a-f*, the interactive gaming table may be operable to display various video images. Typically, a video display may be associated with each player station. The video images generated in the video display areas may be used to change an appearance of the table, such as necessary for the games listed in the previous paragraph. In addition, the video images may be used to display video images, associated with game objects, such as cards, dice, markers, chips, associated with the play of a wager-based game at the interactive gaming table 100. Further, like a bar-top gaming machine, video images for wager-based games not typically associated with a gaming table may also be generated in the video display areas, such as video slot games, video poker and the like. For instance, a video image of a slot game a player might play may be provided as part of a bonus game triggered from a wager-based table game, such as black-jack.

The video images generated in the video display areas may be generated using over-head video projection systems, such as 502, or above the below the table projection systems, such as 504. The projection system may also be orientated to the side of the table or even within the bolster. Using mirrors, many different arrangements of projection systems are possible. Examples of various projection systems that may be utilized herein are described in U.S. patent application Ser. Nos. 10/838,283 (US Pub no. 20050248729), 10/914,922 (US Pub. No. 20060036944), 10/951,492 (US Pub no. 20060066564), 10/969,746 (US Pub. No. 20060092170), 11/182,630 (US Pub no. 20070015574), 11/350,854 (US Pub No. 20070201863), 11/363,750 (US Pub no. 20070188844), 11/370,558 (US Pub No. 20070211921), each of which is incorporated by reference in its entirety and for all purposes. In other embodiments, video displays, such as LCDs (Liquid Crystal Display), Plasma, OLEDs (Organic Light Emitting Display), Transparent (T) OLEDs, Flexible (F)OLEDs, Active matrix (AM) OLED, Passive matrix (PM) OLED, Phosphorescent (PH) OLEDs, SEDs (surface-conduction electron-emitter display), an EPD (ElectroPhoretic display), FEDs (Field Emission Displays) or other suitable display technology may be embedded in the upper surface 102 of the interactive gaming table 100 to display video images viewable in each of the video display areas. EPD displays may be provided by E-ink of Cambridge, Mass. OLED displays of the type list above may be provided by Universal Display Corporation, Ewing, N.J.

In particular embodiments, a video display area, such as 500*a*, may utilize multiple video displays. For example, overhead projection system 502 and an embedded display (not shown) may provide images to video display area 500*a*. In other embodiments, a video display system may provide video images to multiple video display areas. For example, video projection system 502 may be operable to display video images to video display areas 500*a* and 500*b* while video projection system 504 may be operable to display video images to video display areas 500*d*, 500*e* and 500*f*.

Interactive gaming table 100 may include the presence of any of a number of suitable devices and items adapted for the automated tracking of wagers and other gaming activities and transactions at the interactive gaming table. While such transaction, wager and other gaming activity tracking can potentially be done manually, it is specifically contemplated that such tracking be at least partially automated. Such automated tracking of gaming activities and transactions might be accomplished through the use of numerous items, such as, for example, cameras and/or RFID chips and antennae. These components may also be adapted for detecting the presence of physical objects that may be used in a coordinated object detection and video display system. In some embodiments, these components may be used exclusively for the purposes of object detection in the context of coordinated object detection and video display system and not for automatic tracking of wagers and other gaming activities. In yet other embodiments, the tracking system used for wagering and other gaming activities may be separate from the coordinated object detection and video display system.

As a more particular example, RFID based gaming chips can be in use at the table, as well as RFID reading devices and other related components, which may be located beneath the gaming table or in other non-obtrusive locations. The use of such RFID gaming chips and reading devices is known, and various details regarding the use of RFID tags within gaming chips to facilitate gaming chip identification and tracking can be found at, for example, U.S. Pat. Nos. 5,651,548 and 5,735,742, as well as copending and commonly owned U.S. patent application Ser. No. 11/224,903, filed on Sep. 12, 2005, and entitled "Enhanced Gaming Chips and Table Game Security," each of which is incorporated by reference herein in its entirety and for all purposes.

In a particular embodiment, one or more RFID tags within the physical objects, such as chips 105, 106 and 506 or physical objects 508 and 510. The RFID tags may store information that allow physical characteristics of an object to be identified. For example, information stored on RFID tag chip 506 may allow it to be identified as a circular chip with a particular diameter, which is transparent. As another example, information stored an RFID tag on chip 105 may allow it to be identified as a circular chip with a particular diameter that provides a surface that allows video images project from above it to be easily discerned. Further, physical objects 508 and 510 may comprise RFID tags with information that allow the physical dimensions of each of the objects to be determined, including a length, width and thickness.

The physical objects, described herein, may include light-transmissive properties that vary within the object. For instance, in some embodiments, half of object 508 may be transparent and half of object 508 may be opaque, such that video images rendered below the object 508 may be viewed through the transparent half of the object and blocked by the opaque portion. In another example, the outer edges of object 508 may be opaque (see FIGS. 1C-1D) while within the outer edges of object 508 that are opaque, the object 508 may be transparent, such that video images rendered below it may be viewed through the transparent portion. In yet another example, the object 508 may include a plurality of transparent portions surrounded by opaque or translucent portions to provide multiple viewing windows through the object. The object 508 may include an RFID tag that allows the transmissive properties of the object, such as locations of transparent and non-transparent portions of the object or in the case of overhead projection, portions adapted for viewing projected images and portions not adapted for viewing projected images, to be identified.

The location of various objects including RFID in relation to surface 102 may be detected using a number of different methods. For instance, the interactive gaming table may include an antenna array or grid to triangulate a position of each RFID tag. In another instance, different signal frequencies may be sent to each RFID tag and phase shifting of the frequencies may be measured to determine a location of the RFID tag. In yet another instance, the location of an RFID tag may be determined by using antennas with a limited range. Further, the antennas may be positioned such that it may be possible to determine a position of the object when it is resting on surface 102 or above surface 102. Thus, it may be possible to determine whether the object is resting on surface 102 or not. Obviously, a combination of these techniques as well as other techniques known in the art may be utilized to determine a position of an object using RFID tags or other signal emitting devices.

The information included in the RFID tag may allow the position of the RFID tag within the object to be identified, such as at its center. In a particular, embodiment, an object may include multiple RFID tags. For instance, object 508 may include RFID tags at two corners. Using the position data determined for two RFID tags within an object, along with the knowledge of where the RFID tags are embedded in the object and its shape, it may be possible to determine an orientation of the object, such as its proximate foot print on surface 102.

Alternatively, or in combination with RFID tags, the tracking of gaming chips, markers, cards, players and other items and activities at interactive gaming table 100 can be accomplished by way of cameras or other visual equipment, as well as various image processing and software tracking programs. Further details of exemplary visually based gaming chip tracking applications can generally be found at, for example, U.S. Pat. Nos. 5,781,647; 6,313,871; 6,532,297; and 6,663,490, each of which is also incorporated by reference herein in its entirety and for all purposes. In some embodiments, one or more cameras positioned at, within or about interactive gaming table 100 can be adapted to sense and/or record various gaming table statuses, such as the presence or absence of a player at a player station or position, and/or various player gestures. Such player gestures may include, for example, hand motions by the player to "hit" or take another card, or to "stay" or not take another card.

Detected hand gestures may include gestures where all or a portion of a player's hand and/or arm are resting on a surface of the interactive table. In some instances, the detection system may be operable to detect a hand gesture when the hand is a significant distance from the surface of the table. During a hand motion as part of a gesture that is detected for some embodiments, a portion of the player's hand such as a finger may remain in contact continuously or intermittently with the surface of the interactive table or may hover just above the table. In some instances, the detection system may require a portion of the player's hand to remain in contact with the surface for the gesture to be recognized.

The cameras 140 may be utilized with a machine vision system to identify shapes and orientations of physical objects placed on surface 102. Cameras (not shown) may also be mounted below surface 102 for embodiments where the presence of an object may be detected from the beneath the surface 102. The cameras 140 may operable to detect visible and/or infrared light. Also, a combination of visible and infrared light detecting cameras may be utilized. In another embodiment, a stereoscopic camera may be utilized to determine a position of object on surface 102 to be determined.

The objects, such as 506, 508 and 510 may comprise materials that allow them to be more visible to a particular camera, such as including an infrared reflective material in an object to make it more visible under infrared light. Further, the interactive table surface 102 may comprise a non-infrared reflecting material to make infrared reflecting objects standout relative to surface 102 when an infrared camera is used. In addition, the interactive gaming table may include light emitters, such as an infrared light source, that helps to make an object more visible to a particular type of a camera.

The interactive gaming table may include markings, such as shapes of a known dimension, that allow the object detection system to self-calibrate itself in regards to using image data obtained from a camera for the purposes of determining the relative position of objects. In addition, the objects, such as 506, 508 and 510, may include markings that allow information about the objects to be obtained. The markings may be symbol patterns like a bar-code or symbols or patterns that allow object properties to be identified, like the RFID tags previously described. These symbols or patterns may be on a top, bottom, side or any surface of an object depending on where cameras are located, such as below or above the objects. The orientation of pattern or markings and how a machine vision system may perceive them from different angles may be known. Using this information, it may be possible to determine an orientation of objects on interactive table 102

In a particular embodiment, interactive gaming table 100 can be adapted for use with RFID based gaming chips and reading devices, although it will be readily understood that any other suitable wager and gaming activity tracking system may also be used. As such, gaming table 100 can have a chip tray 101 adapted to store a plurality of gaming chips, including RFID gaming chips, as well as a gaming surface such as upper surface 102 adapted for the play of games and various other gaming transactions involving gaming chips, cards, markers and the like. Various chip placement areas 103*a-c*, 104 are distributed about the upper surface 102 of the interactive gaming table 100. Such chip placement areas can include bet or wager placement areas 103*a-c*, as well as cash for chips or other marker conversion area 104. Gaming chips 105, 106 of one or more denominations may also be located atop the upper surface 102 of the interactive gaming table 100, particularly during times of gaming activity at the table. For example, gaming chip 105 may be a $5 chip that is subject to a current wager in a bet placement area, while gaming chip 106 may be a $5 chip that is not subject to a current play or action at the gaming table.

As will be readily appreciated, gaming chips 105 and 106 may be identical or substantially similar, with the possible exception of RFID tags contained within or about the chips. Such RFID tags might be located at the gaming chips in various configurations, as detailed in previously noted U.S. Pat. Nos. 5,651,548 and 5,735,742, and U.S. patent application Ser. No. 11/224,903. In order to facilitate the automated or semi-automated tracking of gaming chips and the detection of other objects and by extension wagers and other gaming activities at the interactive gaming table 100, one or more RFID readers (not shown) can be placed at various locations about the gaming table. One appropriately sized RFID reader for such an application might be, for example, the OEM 50 Read/Writer Module made by HID Corporation of Irvine, Calif., although any suitable RFID writer may be used. It will be readily appreciated that a number of RFID readers may be situated about the gaming table as may be suitable for the accurate reading of chips and wagers.

Interactive gaming table also may include any of a number of different kinds and types of status indicating annunciators, such as a gaming table bolster 200 that extends along at least a portion of the outer circumference of the gaming table. As is generally known, a gaming table bolster can be provided for the comfort of players, and may have one or more player convenient aspects and items, such as a comfortable leather or cloth surface and one or more player cup holders. Such items and materials of construction may also be a part of a gaming table bolster 200, although added materials, such as plastics and metals, might also be present. The gaming table bolster 200 may also include antennas, sensors, cameras and other elements associated with the object detection systems described herein.

In one embodiment, the interactive gaming table 100 may include the ability to sense the presence of active players and provide discernable displays or indicia as to whether any given player position or station is occupied by a player participating in wager based gaming events or is otherwise active at the gaming table. In some instances, the object detection system used to detect the presence of one or more physical objects in a particular video display area may be adapted for this purpose. In other instances, presence of active players may be detected using a separate system. As noted above, one or more cameras 140 positioned at, within or about interactive gaming table 100 can be adapted to sense and/or record the mere presence or absence of a player at a player station or position.

In a particular embodiment, the position of a player may affect how information is rendered in a display area viewable by the player. The video images and associated information in a particular video display window, based upon the orientation of the video display window and the detected position of the player may be rendered in a first manner when the player is determined to be in a first position and in a second manner when the player is determined to be in a second position. For example, in a rectangular shaped video display window viewable through a transparent physical object, text may be orientated in the video images parallel to the longer or short dimension, akin, to a portrait or landscape mode where the determination to display in landscape or portrait mode is based upon a determined position of the player. In general, text may be displayed in any alignment. For example, the text alignment may be rotated in the display window as a player moves so that the text alignment (the lines on which the text appears to be written) is proximately perpendicular to a player's line of sight, such as within 10-15 degrees of perpendicular.

One motion sensing camera that can be adapted for such an application might be, for example, the WVC54GC Compact Wireless-G Internet Video Camera made by Linksys of Irvine, Calif., although any suitable motion detecting camera may be used. Alternative sensors adapted to detect the presence of an active player that may be used instead of or in conjunction with such cameras can include proximity sensors, motion sensors, thermal sensors, pressure sensors, card readers, biometric readers or any other suitable sensor adapted to detect the presence of a player. Another particular example of such a sensor could be, for example, the MS14A EagleEye Wireless Motion Sensor made by the X-10 Corporation of Kent, Wash. Such sensors may be embedded in the gaming table, such as within or about bolster 200, and/or embedded in player seats or other suitable gaming table locations. As yet another possibility, pressure sensors embedded within each seat may be used to detect the presence of a player. Such a pressure sensor might be, for example, the ASDX015A24R model pressure transducer made by Honeywell International, Inc. of Morristown, N.J.

While the use of player detecting sensors, such as cameras, card readers, and seat based pressure sensors, might be expected to account for the detection of most all players that would be active at interactive gaming table 100, such sensors or combinations of sensors might not be entirely foolproof. Accordingly, it is also contemplated that one or more manual inputs be provided, with such manual inputs being located at a live dealer station, one or more of the active player stations or positions and/or at other locations that are readily accessible to casino personnel. In this manner, such manual inputs may be used to positively establish the presence or absence of a player at a given player station or position. As one example, the actions of a particularly fidgety player or a player that frequently leaves the table for a short time, such as to smoke, but wants to hold his or her seat, might cause havoc with the automated sensors attempting to establish whether or not an active player is present at the seat (i.e., player position) of that player. In such situations, the player, the table dealer, or other casino personnel could be permitted to press a button to indicate that that particular player position is occupied.

In response to detecting active players or otherwise designating that active players are present at interactive gaming table 100, and in general at any particular player location or station at the gaming table, one or more indicators or "annunciators" of such player presence or status can be employed. For example, one or more lights within bolster 200 can be activated or deactivated depending upon player presence, player absence, or other player status at the gaming table or a given player position. In one embodiment, different portions of bolster 200 can be made to light up or turn off depending upon whether an active player is present at a given bolster section and playing at the gaming table. In addition, one or more regions of the playing surface 102 of interactive gaming table 100 can be made to light up or otherwise indicate a player status. Also, signs, sound output devices or additional lights might be used to indicate a game or player status at the table. Such annunciators may be seen not only by those near the gaming table, but also by others located at some distance from the gaming table. In this manner, potential players and casino personnel can recognize even at a distance which gaming tables have open seats and which seats are open. As will be readily appreciated, such player status might not only indicate whether an active or live player is present at the gaming table, but might also involve a game status, such as whose turn it is and whether or not a player has won, lost, is in the lead, and so forth.

Figure 1B:
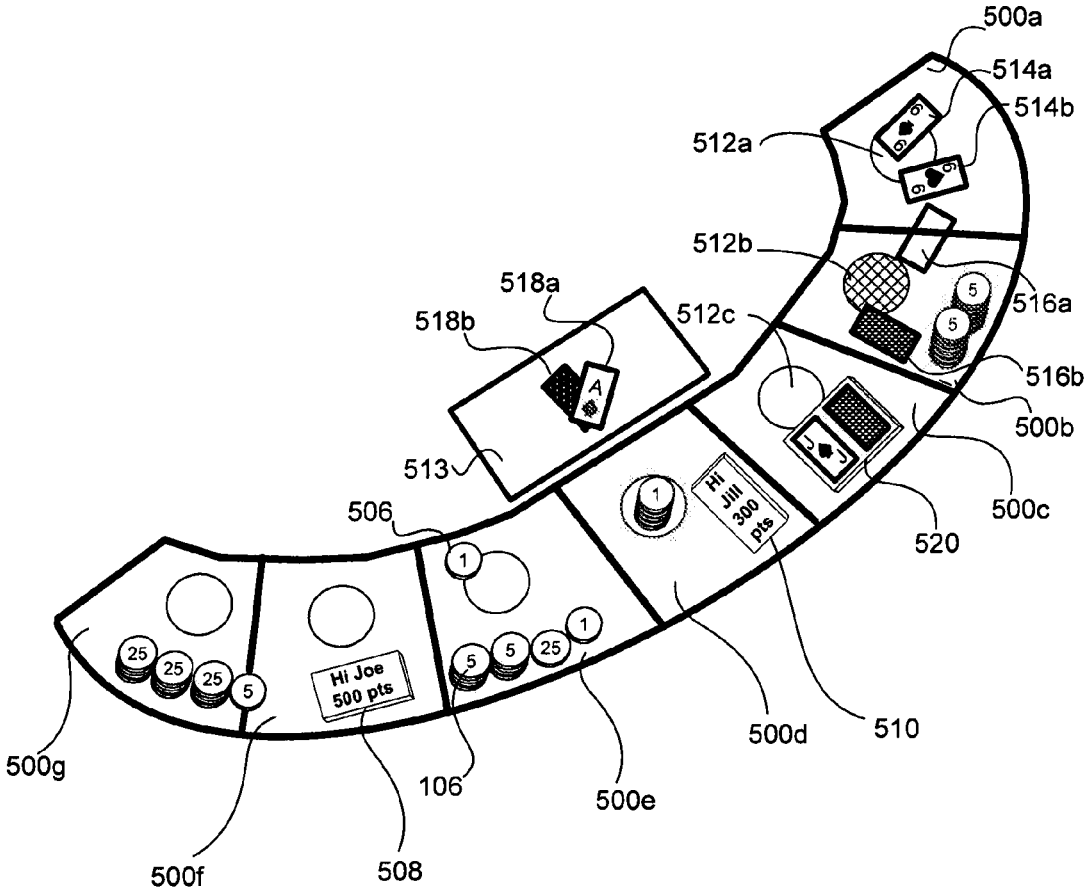

FIG. 1B illustrates in top perspective view of surface 102 in FIG. 1A of an exemplary interactive gaming table according to one embodiment of the present invention. In this embodiment, a video display area 513 for a dealer or table operator is provided. In video display area 513, two cards are generated where one is rendered as face up and one is rendered as face down in the video images. These cards may be rendered under control of master gaming table controller (see FIG. 3) that may be used to generate a wager-based game, such as a card game, played on the interactive gaming table.

Resting on top of video display area 513 are two transparent card shaped objects 518*a* and 518*b* where images are rendered beneath the objects 518*a* and 518*b*. In one embodiment, the card shaped objects may have been placed on the surface by an operator at the table. In one embodiment, the object detection system may be able to detect whether two objects are overlapping and adjust a size of a video display window so that a video images over-lapping objects are viewable through the objects as in shown in FIG. 1B. Further, the object detection may be able to determine which object is on top of the other object and render video images viewable through the objects such that one object appears to covering another object. For example, in FIG. 1B, object 518*a* is on top of object 518*b*, video images viewable through the objects 518*a* and 518*b* are rendered such that a video image associated with 518*a* appears to be covering a video image associated with 518*b*.

In addition, when the physical objects, 518*a* and 518*b*, are moved to a more overlapping position, the video images may appear to be more overlapped. When physical object 518*a* is stacked on top of physical object 518*b*, then the video images may be rendered such that a video image associated with 518*b* is no longer visible. This methodology may be applied to a plurality of stacked objects, such as a card hand, comprising 5 or 7 transparent physical objects. The player may receive a stack of 5 physical transparent objects placed on a surface of the interactive gaming table, as the objects were spread out, video images visible through the objects may be rendered that follow the shape of the overlapping physical cards. The multiple physical objects may be divided into a number of overlapping and non-overlapping stacks or may be all physically separated such that none of the physical objects overlap and corresponding video images generated that are viewable through or on top of the overlapping or non-overlapping objects.

In another embodiment, the object detection system may not allow one physical object, such as 518*a* or 518*b*, to overlap one another. In this embodiment, when the object detection system detects two physical objects overlapping one another, the interactive gaming table may be operable to generate a message to separate the objects, such as 518*a* and 518*b*. When the objects 518*a* and 518*b* are separated in video display area 513, then the interactive active gaming table may open a first video display window under 518*a* and a second video display window under 518*b* and render video images of a playing card in each window, respectively.

While playing a game, such as a card game, a particular number of physical objects may be provided to each player, as well as the dealer, to play the game. For example, for a black jack game, in one embodiment, two physical objects, such as, a pair 514*a* and 514*b*, or a pair 516*a* and 516*b*, may be distributed to each player. The interactive gaming table 100 may be operable to determine that there are a correct number of physical objects in each video display area, such as 500*a-f*.

When the interactive gaming table 100 detects that are correct number of physical objects are not within each video display area, then the interactive gaming table may be operable to generate a textual message or other visual indicator to correct the deficiency. For instance, in FIG. 1B, physical object is shown overlapping two video display areas 500*a* and 500*b*. In one embodiment, video images in chip placement area 512*b* may provide a flashing pattern to indicate that a correct number of physical objects are not in the video display area 500*b*. In another embodiment, the interactive gaming table may flash a pattern under object 516*a* and then show the object under 516*a* moving into a correct position within video display area 500*b*.

The interactive gaming table 100 may be operable to distinguish between physical objects that may alter video images as part of playing a game and physical objects utilized to alter video images for other purposes. For example, if object 510 were placed in video display area 500*a*, the interactive gaming table 100 may be operable to determine that objects 514*a* and 514*b* are each used to trigger a display of video images of playing cards when located in video display area 500*a* and to determine that object 510 is associated with another functions, such as to trigger a player tracking interface, a bonus interface or a secondary game playing interface. Thus, when the interactive gaming table 100 detected the presence of all three objects, where only the two objects 514*a* and 514*b*, may be needed to play the game, the interactive gaming table 100 may not trigger an error message.

As described with respect to FIG. 1A, physical objects used to trigger a display of video images may include multiple transparent portions that are segmented in some manner that allow video images to be viewed through the object, such as two transparent portions separated by non-transparent portions. Object 520 is one example of such an object. Object 520 includes two transparent portions that are card sized. The interactive gaming table 100 may be configured to display video images of two playing cards that are viewable through the each transparent portion of object 520. In FIG. 1B, video images of one card revealed and one card not revealed are rendered and are viewable through object 520.

In particular embodiments, a particular object, such as 510, may be associated with a limited number of functions that affect the content of video images that may be associated with the physical object. For instance, the interactive gaming table may only associate object 510 with a player tracking interface and only generate video images associated with the player tracking interface. In another example, the interactive gaming table may only associate object 510 with a bonus interface and only provide images associated with bonusing in a video display window viewable through the object. In yet another example, the interactive gaming table may only associate object 510 with a secondary game playing interface and only provide video images related to a play of a secondary games, such as a slot game, that is viewable through the object 510.

In other embodiments, the interactive gaming table may provide a menu driven system that allows content displayed in video images viewable through an object, such as objects 508 and 510, to be dynamically altered by a player. The interactive gaming table 100 may be operable to detect touch selections made by a player on a video menu. The touch menu may be provided on a touch screen that is located adjacent to the physical object that allows a user to provide touch inputs in response to video images rendered with selectable items where the interactive gaming table 100 is operable to determine a location of the touch input and associate it with a particular item rendered in the video images.

In another embodiment, the surface of an object such as 508 may include a touch sensor where touches made to the surface of the object may be received by the interactive gaming table. The touch sensor may generate an electrical signal in response to a touch being made and information regarding that signal may be sent from the object to the interactive gaming table. In particular embodiments, the touch screen sensor may be at least one of a capacitive touch screen sensor, a resistive touch screen sensor and an acoustic wave touch screen sensor.

In another embodiment, a touch system the I-Tech VKB manufactured by Hutchison Harbour Ring Limited—HHR, a subsidiary of Hutchison Whampoa Limited. With this technology which may be mounted in one embodiment in a table bolster, a template of the desired interface is projected onto the adjacent interface surface. The template may be produced by illuminating a specially designed, highly efficient holographic optical element with a red diode laser. The template may serve as a reference for the user and is not involved in the detection process. In a fixed environment, the template may be printed onto the interface surface. Next, a reference plane is illuminated. For instance, an infra-red plane of light is generated just above, and parallel to, the interface surface. This light may be invisible to the user and may hover a few millimeters above the surface.

When the user touches a key position or other location on the template on the interface surface light is reflected from this plane in the vicinity of the key and directed towards the sensor module. Nest, reflected light from user interactions with the interface surface may be passed through an infra-red filter and imaged on to a CMOS image sensor in the sensor module. Hardware embedded in the sensor chip may then make a real-time determination of the location of the reflected light. The processing core can track multiple reflection events simultaneously and can thus support both multiple keystrokes and overlapping cursor control inputs in the example of keyboard.

Besides touches at a particular location, this type of system may also be used to track a position of objects on the table. Since the light hovers a few millimeters above the surface, a suitable location for this type of system might be in a gaming table bolster or some other location that may be provide a surface that rises above a playing surface of the interactive table. For a system, such as an acoustic touch screen sensor, a surface that rises above the playing surface might also be suitable for acoustic sensors. In another embodiment, a laser scanner, like a bar-code reader used in a supermarket might also be located in this location to read information from objects, such as a bar-code written on the side of an object perpendicular to a playing surface, such as a bar-code on this side of chip placed on the table.

In another embodiment, when a touch is made, a light pulse at the location of the touch may be triggered on the object. The object 510 may include two layers of materials, such that when contact is made between the layers a light pulse may be emitted at the point of contact. The light pulse may be captured by a camera and the location of the touch determined from the camera image.

The interactive gaming table 100 may be operable to detect touches made on a top surface of a physical object, such as 508, 510, 514*a*, 514*b*, 516*a* or 516*b*. For example, when a player touches the top of one of the physical objects that comprises a transparent portion a shadow may be detected below the object at a particular location. The location where the shadow is detected may be associated with a selectable item rendered in a video image that is viewable through the object. In another embodiment, a machine vision system may be used to determine that a player's finger has touched an object at a particular location and map that to a selection of a particular menu item viewable in a rendered video image. Using a machine vision system, touches on a side of an object, such as a cube or on surface of a rounded object, such as a hemisphere may be detected. The interactive gaming table 100 may be configured to map the touch location on a surface of an object to a selection of a particular menu item rendered in a video image that is viewable through, on top of or adjacent to a particular object.

In yet other embodiments, one physical object may be related to another physical object, such that the video images that are generated in response to detecting the physical objects displayed related content. For example, objects 508 and 510 may be associated with a shared bonus game and thus video images related to the bonus game may be viewable through or on top of objects 508 and 510 when the objects 508 or 510 is placed on the table. The object detection system may be able to acquire information, as previously described, that allows the interactive gaming table 100 to determine that the objects 508 and 510 are to receive video images including shared or common content.

In a particular embodiment, the shared bonus game may be available for play at multiple interactive gaming tables. Thus, when object 508 is placed at a first interactive gaming table and object 510 is placed at a second interactive gaming table, the first and second interactive gaming tables may be networked in a manner that allows video images including shared content to be displayed.

The video images with the shared content that are displayed in response to a detection of objects 508 and 510 don't have to be identical. For instance, two players playing in a tournament game may receive shared content comprising the leader board the tournament and then individual content comprising their score in the tournament and their name. Thus, in general, two objects that are linked such that they trigger a display of video images with shared content may include a mixture of shared content and individual content.

In another example, a group of physical objects may be provided to a group of players that have a number of events planned. When the physical objects for each player in the group are placed on a video display area of an interactive gaming table, information associated with the group may be displayed. The information may include but is not limited to a calendar or schedule of group activities, messages directed to the group as a whole or to individuals in the group, promotions or bonuses provided by a casino that are only available to group members.

Figure 1C:
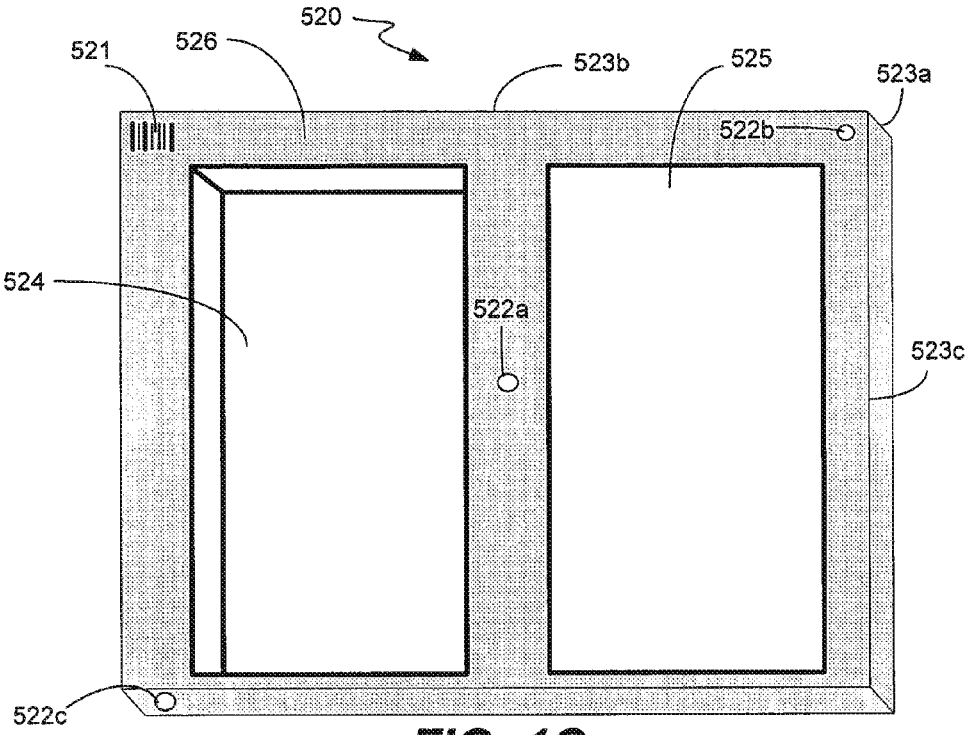
FIGS. 1C-1D illustrate in top perspective examples of physical objects that can be utilized with coordinated object detection and video display system.
Figure 1D:
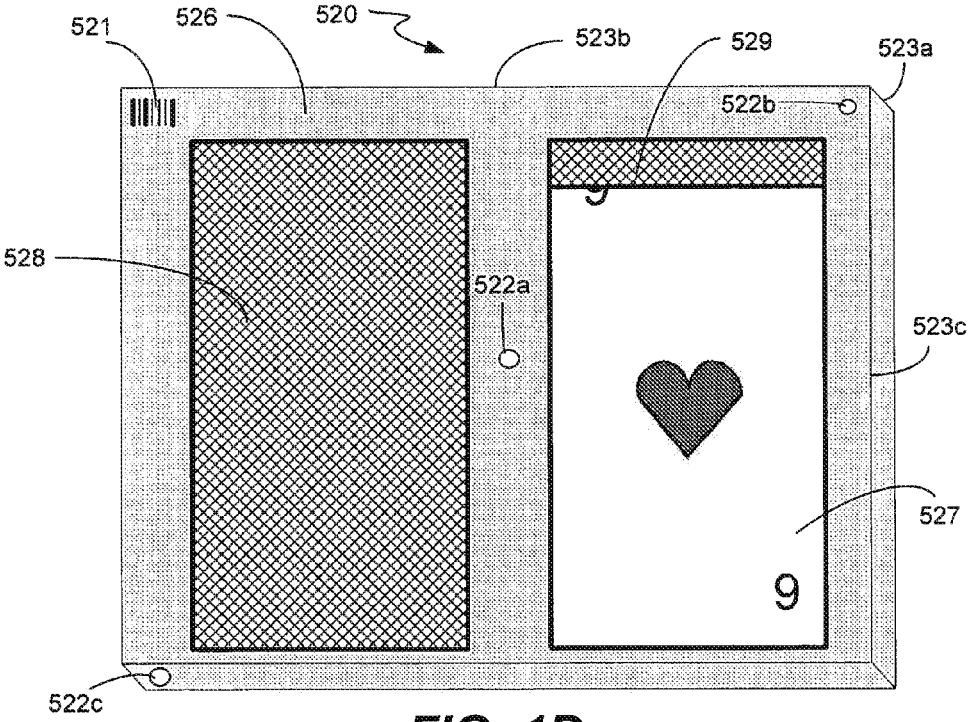

FIGS. 1C-1D illustrate in top perspective two examples of physical objects that can be utilized with coordinated object detection and video display system. In FIGS. 1C and 1D provide different potential embodiments of physical object 520 described with respect to FIG. 1B. In FIG. 1C, the object 520 may comprise outer dimensions of 523*a*, 523*b* and 523*c*. In one embodiment, the object 520 may comprise two areas 524 and 525 suitable for allowing video images to be viewed through the areas when video projection from underneath is used. In this embodiment, the two areas 524 and 525 may be surrounded by an opaque or translucent material that provides a boarder around each of the two areas 524 and 525. In another embodiment, the two areas 524 and 525 may comprise a material that is suitable for viewing video images that are projected from above the object where the surrounding material 526 may selected to provide a suitable contrast to the video images projected in 524 and 525.

In yet another embodiment, areas 524 and/or 525 may provide display capabilities. For instance, area 525 may be a one of TOLED, EPD or an LCD type display that may be operable to generate video images separately from the interactive display table. For example, in FIG. 1D, a backing of a card is shown in area 528, the image of the card backing may be generated using a display capability of the object 520 to "hide" a video image generated underneath the object 520, such as the video image of a card in area 527. In area 527, an image 529 is generated on the object 520 that partially blocks the image of the card. The size of the image 529 may be controlled by a player's touch, such that as a player moves their finger over area 527, the size of area 529 may shrink or grow to reveal more of the card or to cover the card.

The object 520 may include sensors, such as a touch screen sensor, that allows a position of a player's touch to be determined. The object 520 may comprise a logic device that is configured to process information from a touch sensor and provide instructions to a display included with the object. In other embodiments, a location of a touch may be determined by a device not directly coupled to the object 520, such as the object detection system previously described and then touch information, such as location of a touch may be transmitted from the interactive gaming table 100 to the object via a communication interface located on object 520.

In another embodiment, touch information or sensor information detected on object 520 by a sensor coupled to the object may be transmitted from the object 520 to the interactive gaming table 100. The touch or the sensor information may be used by the interactive gaming table 100 to alter video images provided on the interactive gaming table 100. For example, the video images of the card and the portion 529 that appears to be covering the card may be generated by the interactive gaming table 100 where the size of portion 529 may be adjusted according to touch or sensor information detected using object 520 and sent to the interactive gaming table 100, such as when object 520 includes a touch screen sensor.

In yet other embodiments, the object 520 may include a hollow or recessed portion. For instance, area 524 in FIG. 1C may be a hollow cavity in object 520. In another embodiment, area 524 may be a transparent thin layer of material that is recessed below the top portion of the object 520.

The object 520 may include one or more sensors, emitters, RFID tags or electronic components (e.g., power source, video screen, logic device, processor, memory, a touch pad, a roll ball, a wheel, or a communication interface), such as

522*a*, 522*b* and 522*c*, which may be embedded in various locations. For example, 522*c* is embedded in a side of object 520 while 522*a* and 522*b* are located near top of object 520. In one embodiment, 522*a*, 522*b* or 522*c* may be an RFID tag, a light source, such as an infrared light source or other signal emitter that may be used to help determine an orientation of the object or a sensor that may be used to provide information about the object. For instance, a magnetic sensor may be employed to help determine an orientation of the object 520 when placed on the interactive gaming table. In another embodiment, a touch pad, a roll ball, a wheel normally associated with devices such as computer mouse or portable pc may be provide on object 520 to provide input.

The object 520 may include one or more marking that may be detected by an object detection system. For example, the object detection system may include a camera that may be able to detect markings on a surface of the object 520, such as bar-code 521. The markings may be on a top surface, lower surface or side and may vary according to a shape of the object 520 as well as a location of data acquisition components, such as cameras. The markings, such as bar code 521, may be used to convey information about the object 520, such as an identification number. The markings are not limited to bar-codes and any set of defined patterns or symbols may be utilized to convey information about the object 520. Further, in some embodiments, the markings may be of a known location and orientation on the object 520 and may be used by the object detection system to determine an orientation of the object.

The objects 520 in FIGS. 1C and 1D may include one or more mechanical elements, such as a hinged opaque door that may be opened or closed to reveal a video image beneath the object 520 or a sliding portion that could be slide open or closed to reveal an image below the sliding portion. In another embodiment, the object 520 may comprise two elements, one with area 528 and one with area 527 that may be joined to form one object or separated to form two objects. As previously noted, a size, a shape and a number of transparent portions that are utilized with a video image may vary from object to object.

Figure 2A:
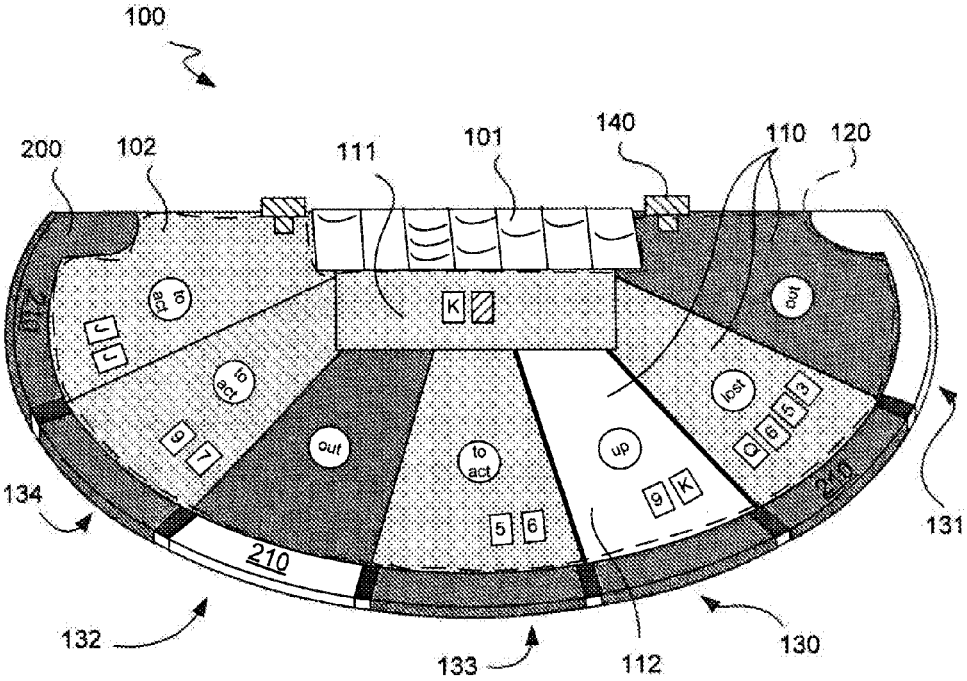
FIG. 2A illustrates in top plan view a more detailed rendition of the exemplary interactive gaming table of FIG. 1A according to one exemplary embodiment of the present invention.
Figure 2B:
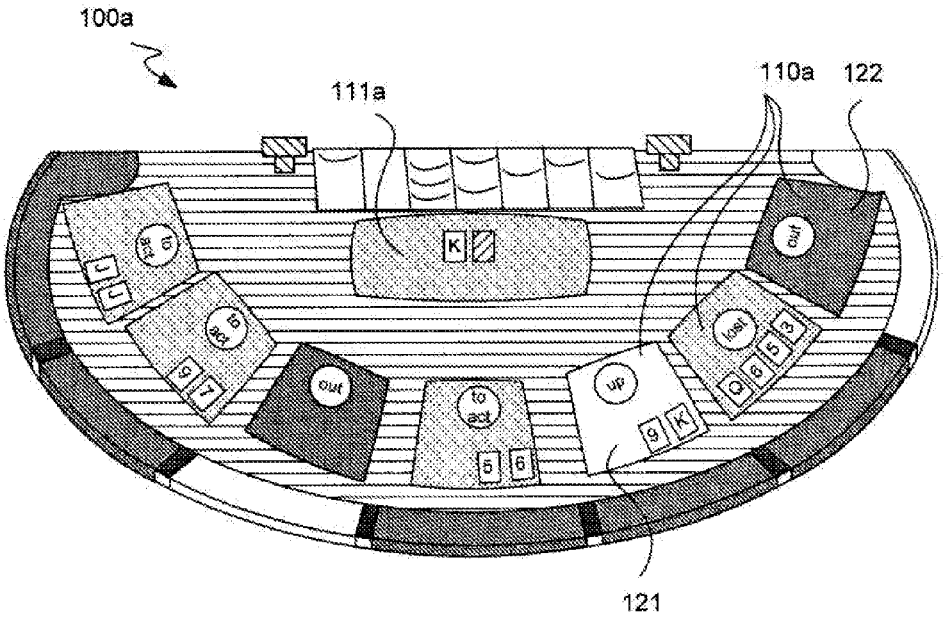
FIG. 2B illustrates in top plan view a more detailed rendition of the exemplary interactive gaming table of FIG. 1A according to an alternative exemplary embodiment of the present invention.

Turning now to FIGS. 2A and 2B, more detailed renditions of the interactive gaming table of FIG. 1A according to two exemplary embodiments of the present invention is illustrated in top plan view. As can be seen from both figures, interactive gaming table 100, 100*a* can be made to resemble half a pie that is split into "pie pieces" or sections 110, 110*a*, with each such pie piece or section corresponding to a player position or station. As shown, FIG. 2A illustrates interactive gaming table 100 as being split into full pie pieces 110, while FIG. 2B depicts interactive gaming table 100*a* as having partial pie pieces 110*a*. As will be readily appreciated, full pie pieces, partial pie pieces or other alternative layouts or sections might also be used without detracting from the spirit or scope of the invention. A dealer position or station, such as illustrated dealer positions 111 and 111*a*, may also be represented by such a pie piece, partial pie piece or alternative section.

In various embodiments, upper or playing surface 102 can include one or more displays 120, 121, 122 adapted for the play of table games on interactive gaming table 100. Such displays can include a liquid crystal display ("LCD"), a plasma display, a flat panel display, or any other display suitable for displaying events on one or more gaming table surfaces or facets. In some embodiments, the entire playing surface 102 can be one large LCD or plasma display, such as full LCD playing surface 120 in FIG. 2A. These displays may provide video images in a viewing display area as discussed with respect to FIG. 1A.

Various examples and further details for such a gaming table surface display are disclosed in commonly assigned and copending U.S. patent application Ser. No. 11/517,861, by Underdahl, et al., entitled "Casino Display Methods and Devices," which is incorporated by reference herein in its entirety and for all purposes. Such a display could be one that is commonly produced by a display manufacturer, or could be a customized display built specifically for the shape of the gaming table. One display that can be adapted for such an application might be, for example, the PX350 flat panel display made by Smart, Technologies, Inc. of Calgary, Canada. Alternatively, some portion of playing surface 102 can comprise multiple smaller displays, such as partial LCD playing surfaces 121 and 122 in FIG. 2B. Other configurations of displays embedded into playing surfaces may also be used, as will be readily appreciated. In any such instance, such playing surface displays can be used to project a table game layout onto the surface of the gaming table, such as a blackjack layout. Such a layout might then be changed by a casino operator as desired, as set forth in greater detail below.

As noted above, each piece or alternative player section atop a display playing surface can be programmed to light up for a player for a particular player status, such as when it is the turn of the player at a relevant player section or station, for a winning outcome for a relevant player or position, a bonus eligibility notice or win, or some other distinguishing event for the respective player. Referencing FIG. 2A for one particular example, "pie piece" 112 within full display playing surface 120 could light up when it is the turn to act for the respective player at player station 130. Taking this example a step further, the full display playing surface 120 can be programmed to project a normal table game layout, such as a blackjack layout, across the full surface of the gaming table. As shown, the display surface pie piece for each player section might be darkened or even blacked out for any player section where no live player is present, such as at player stations or positions 131 and 132. Also, the relevant display surface pie piece or pieces could remain at a normalized lit level for active players who are not up to act, such as at player positions 133 and 134, and could be brightened, outlined or enhanced in some manner to indicate whose turn it is to act, such as at player station 130. Further indicators that might show which player (or dealer) is to act next could include arrows, a carat, or a bouncing dot or animated character that proceeds around the table to indicate turn status.

Furthermore, as detailed herein, the bolster 200 may have bolster sections that can be darkened or lit up according to whether not an active player is present at a given player station or position. Referring again to FIG. 2A, it can be seen that there are exactly seven player stations 110 at interactive gaming table 100, and that each player station has its own separate bolster section 210. Of course, there may be fewer or more designated player stations at an interactive gaming table, and there may also be more than one bolster section per player station, as may be desired. In this particular illustrative example, all player stations at interactive gaming table 100 have active players present, except for player stations or positions 131 and 132. Accordingly, the bolster section at player positions 131 and 132 are illuminated to indicate to everyone that these particular player stations are open for new active players to participate at interactive gaming table 100. Since players are present at each of the other player positions, the bolster sections 210 for each of these other player positions are not illuminated in this example. In detailed variations, bolster 200 may be lit up differently to indicate a preferred player position or status, such as a golden color for a "Gold Card" member.

As noted above, one or cameras, as well as other sensing devices, may be used to read and track playing cards, dice, chips, markers, tokens and other physical objects present on the interactive gaming table. In addition, player biometrics might also be read, such as facial features that are then used in conjunction with facial recognition software, such as for player tracking or cheater identification purposes. Such facial recognition hardware and software might be part of a system provided or supported by, for example, the Bio Face Recognition System by Security Lab, Ltd. of New York, N.Y. Such cameras might also be used to read, track and even interpret gestures of players, such as to "hit" a new card or "stay" and take no further cards.

In addition, the detection of such information may influence content of video images displayed in a video display window and viewed through a physical object placed on the surface of the interactive gaming table 100. In one example, if a player's facial features can be used to identify the player, then in response, the information displayed in the video display window may be customized to that particular player. In another example, player gesture to hit or stay might change a game object, such as a card, displayed in the video display window. In this example and other instances (e.g., other game play events), where a detection of the player gesture may influence the outcome of the wager-based table game, information regarding the event detected (e.g., a gesture to hit or stay) may be stored to a power-hit tolerant memory and may be made available for later retrieval.

As an example, a player may make a gesture to request another card ("hit"), the card may then be revealed in a video display area that is viewed through a physical object as previously described. The viewing of the card may require an additional action by the player, such as cupping their hands around the physical object or tapping the physical object. After viewing the card, a player may dispute that they made a "hit" or "stay" gesture and ask that the table game be reset to the game state prior to their requesting the new card. The interactive game table upon receiving input from an operator entered via an interface to the interactive game table may be operable to retrieve information, such as video frame data showing the gesture made by the player to take another card and the player's gesture to reveal the new card from a memory accessible to the interactive game table and play the record back on a video display. The record played back may be viewable to the operator alone, the player alone or to both the player and operator simultaneously. More details of game history recording and playback are described with respect to FIG. 6.

For the purposes of biometric information detection, one or more wide-angle cameras 140 such as the Model RPU-C1833 Chameleon Eye Camera made by Sony Corporation of Tokyo, Japan, might be positioned about interactive gaming table 100 to capture and track such player motion indicators. As is generally known, motion detection cameras and movement interpretation software can be used to interpret many different motions, particularly where such motions are sweeping or otherwise quite distinguishable. Such technology is offered by, for example, GestureTek, Inc. of Toronto, Canada, among others. Various noted and acceptable player motions or gestures for "hit" or "stay" could be programmed into the relevant software, such that the computing system at interactive gaming table 100 can interpret many player motions for these activities. In some embodiments, microphones at the gaming table and voice recognition software might also be used in a similar manner.

In addition to the various tracking cameras that might be used, such as wide angle cameras 140 and/or the various types of tracking cameras disclosed in the outside references incorporated herein, one or more added overhead cameras (not shown) can be focused on the activities of interactive gaming table 100 and adapted to show such activities. Statuses such as who is winning, what players are active, whose turn it is, what cards are visible, which players have what chips, and other factors of interest might then be displayed. Such displays could be made to the players at the gaming table, at a location nearby the gaming table, elsewhere within the gaming establishment, such as to remotely located personnel, or to viewers on a live or recorded program, such as for a televised poker tournament.

Figure 3:
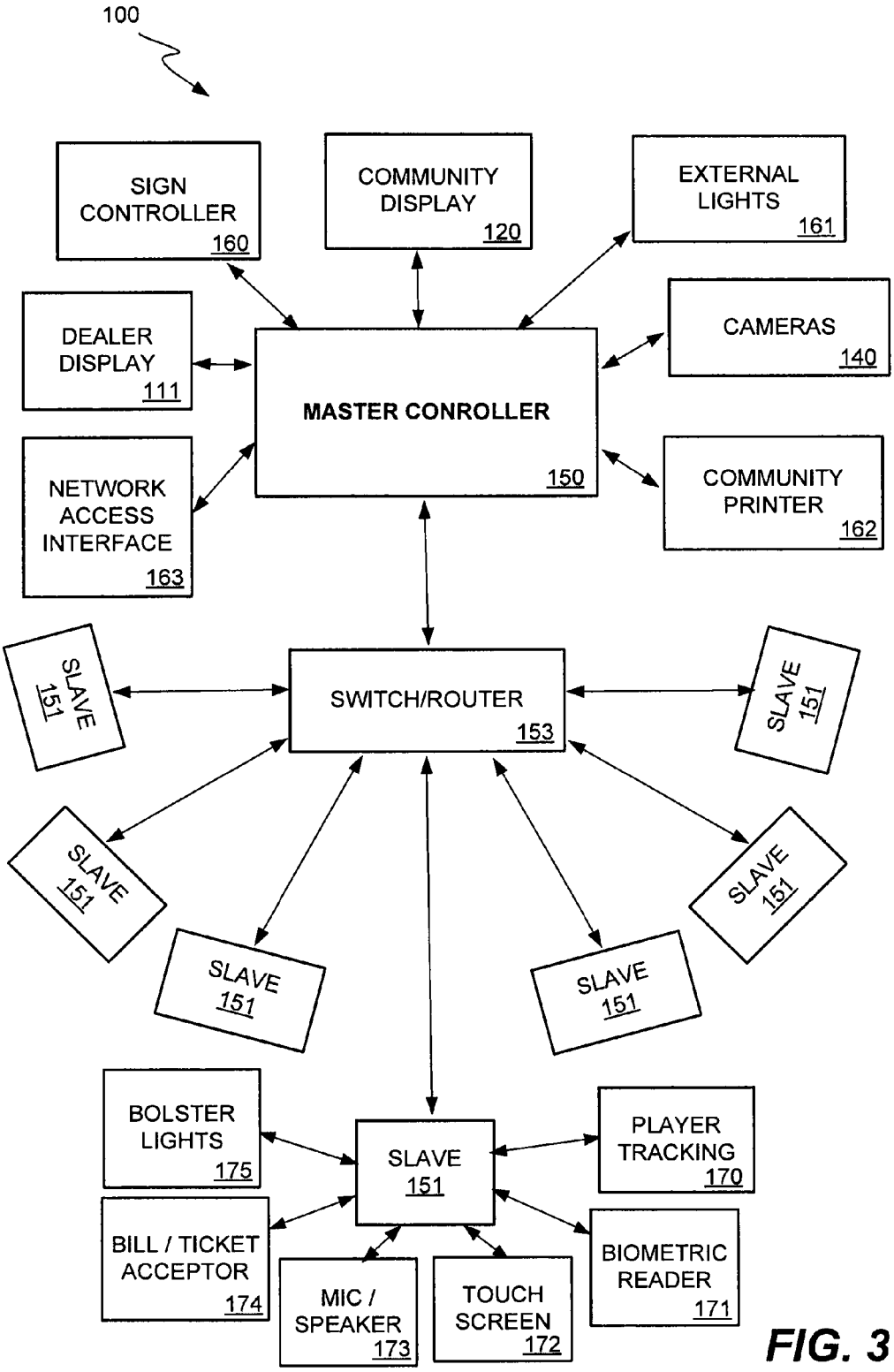
FIG. 3 illustrates in block diagram format an overview of the entire electronic infrastructure of the exemplary interactive gaming table of FIG. 1A according to one embodiment of the present invention.

Moving next to FIG. 3 an overview of the entire electronic infrastructure of the exemplary interactive gaming table of FIG. 1 according to one embodiment of the present invention is provided in block diagram format. As might be appreciated, one or more microprocessors and other electronic equipment may be present at interactive gaming table 100 in order to process the myriad peripherals, devices and functions present. In various embodiments, a master gaming table controller 150 can be adapted to the primary microprocessor or control device at the interactive gaming table. One device that could serve as such a master table gaming controller could be, for example, the BOXDG965RYCK ATX Motherboard made by Intel, Corporation of Santa Clara, Calif., although it will be appreciated that a wide variety of alternative suitable primary processing boards and components could be used for such an item. Such a master gaming table controller can be responsible for controlling and coordinating functions and efforts between a plurality of slave controllers 151 as well as having control of global table functions. Such slave controllers 151 might each be, for example, a Lifebook© P7120 Notebook made by Fujitsu, Ltd. of Tokyo, Japan, although any suitable processing device that can be adapted as a slave device may be used. Master gaming table controller 150 might be adapted to drive any playing surface LCDs, such as a community display (i.e., LCD 120), table signage 160, spotlights or external lights 161, cameras 140, a community printer 162, one or more network access interfaces 163 and other items used to facilitate communications between the gaming table and any outside networked devices or components, among other items. A wide variety of suitable items may be used for the various peripherals listed here, with one such example being an Ithaca iTherm 280 model thermal printer made by Trans-Act Technologies, Inc. of Wallingford, Conn. as printer 162.

In addition to the synchronization of individual slave controllers, master table game controller 150 can also be responsible for oversight and coordination of communications to and between various table devices, control of a progressive table bonus for the interactive gaming table, and controls for the various tracking devices at the gaming table, such as tracking cameras and/or RFID devices. Further functions can include the coordination of downloads, signage, player positions, table traffic and play or action sequences, as well as control of one or more communications access interfaces, such as a wireless antenna that enables wireless communication with other interactive tables and/or a remote interactive gaming table server. Master gaming table controller 150 can also be adapted to keep an audit trail of a variety of table events and transactions, and can also be adapted to send such audit trail information to the interactive gaming table server or some other remote server. Such audit information might include, for example, financial transactions such as buy-ins or color-ups, game outcomes, and various player tracking items, such as time in and out, time spent, amounts wagered and amounts won or lost.

Each slave controller 151 may be connected to master table gaming controller 150 by a switch or routing device 153, such as an Ethernet router. Such a router might be, for example, the Instant Broadband EtherFast Cable/DSL Firewall Router, Part No. BEFSX41, made by Linksys of Irvine, Calif., although any suitable routing device may be used. Such a device can help to control and coordinate efforts between the various slave devices, such as by indicating to a given slave controller when action or input is requested of a given player station controlled by that given slave controller. In various embodiments, a plurality of slave controllers 151 can be implemented at each player position at the interactive gaming table in order to oversee and coordinate control of functions at each player station. For example, there may be one dedicated slave controller 151 dedicated for every player position or station. Of course, more than one slave controller may be provided for each player position, or alternatively, one slave controller may be adapted to control several player stations.

Optionally, an additional slave controller (not shown) can be added to provide similar oversight and control of a live dealer and/or virtual dealer station. Each slave controller 151 can control with a wide variety of peripheral devices and items that are associated with its respective player or dealer station, such as, for example, player card readers or other player tracking devices 170, fingerprint or other biometric readers 171, individual player touchscreens or other displays 172, ticket acceptors, microphones, speakers and/or other sound output devices 173, bill acceptors, ticket acceptors, coin acceptors and/or other credit accepting devices 174, and individual bolster lights 175, among other various peripherals and devices. It will be readily appreciated that not all peripherals listed here need be used in association with a given slave controller or player station, that other peripherals not listed may be used, and that different player stations or slave devices may control different types and numbers of peripherals, as may be desired. Furthermore, while peripheral devices and items have been illustrated for one exemplary slave controller, it will be understood that any or all slave devices may have identical or similar arrangements.

In some embodiments, the interactive gaming table can be cashless and/or cardless, such that tickets, player tracking cards, smart cards, credit cards, and/or player biometrics can be used to facilitate cashless play, such as by utilizing cashless tickets or obtaining biometric player information and then linking players to remotely administered player accounts. In a particular embodiment, a placement and detection of a physical object on a surface of the interactive game table may trigger the opening of a video display window viewable through the physical object that provides or augments a cashless interface.

For instance, in one embodiment, a physical object may be associated with a cashless function. When placed on an interactive game table, the object detection system detect the physical object, determine alone or in combination with the master gaming table controller that the physical object is associated with a cashless function and then a video display interface that is viewable through at least a portion the physical object may be opened in a video display window that allows one or more cashless functions to be performed. For example, the video display interface may display one or more of a player's name, a message requesting the player enter a PIN or password, an input interface that allows the PIN or the password to be entered, an account balance and an interface that allows cash or indicia of credit to be deposited or withdrawn from the account. The account information may have to be retrieved from a gaming device remote to the interactive gaming table via a network.

The cashless function of the physical object may be associated with a physical characteristic, such as its shape, a physical dimension, a color, marking on the object or a combination thereof, such that when the physical characteristic or combination of physical characteristics is detected, a video display window providing the cashless function is instantiated. Further, information regarding the cashless function may be stored on the physical object, such as on an RFID tag coupled to the physical object. Thus, the interactive game table may make use of one or more communications access interfaces, such as a wireless antenna (not shown) or an RFID reader.

The communication access interfaces may also be used to communicate with other remote devices, such as a remote device storing cashless information utilized to provide a cashless service at the interactive gaming table. Of course, wired interfaces may also be used, as may be desired. Further details of wireless access interfaces and communications from and between interactive gaming tables within an overall interactive gaming table network are provided in greater detail below.

Networked Interactive Gaming Tables and Systems

Figure 4:
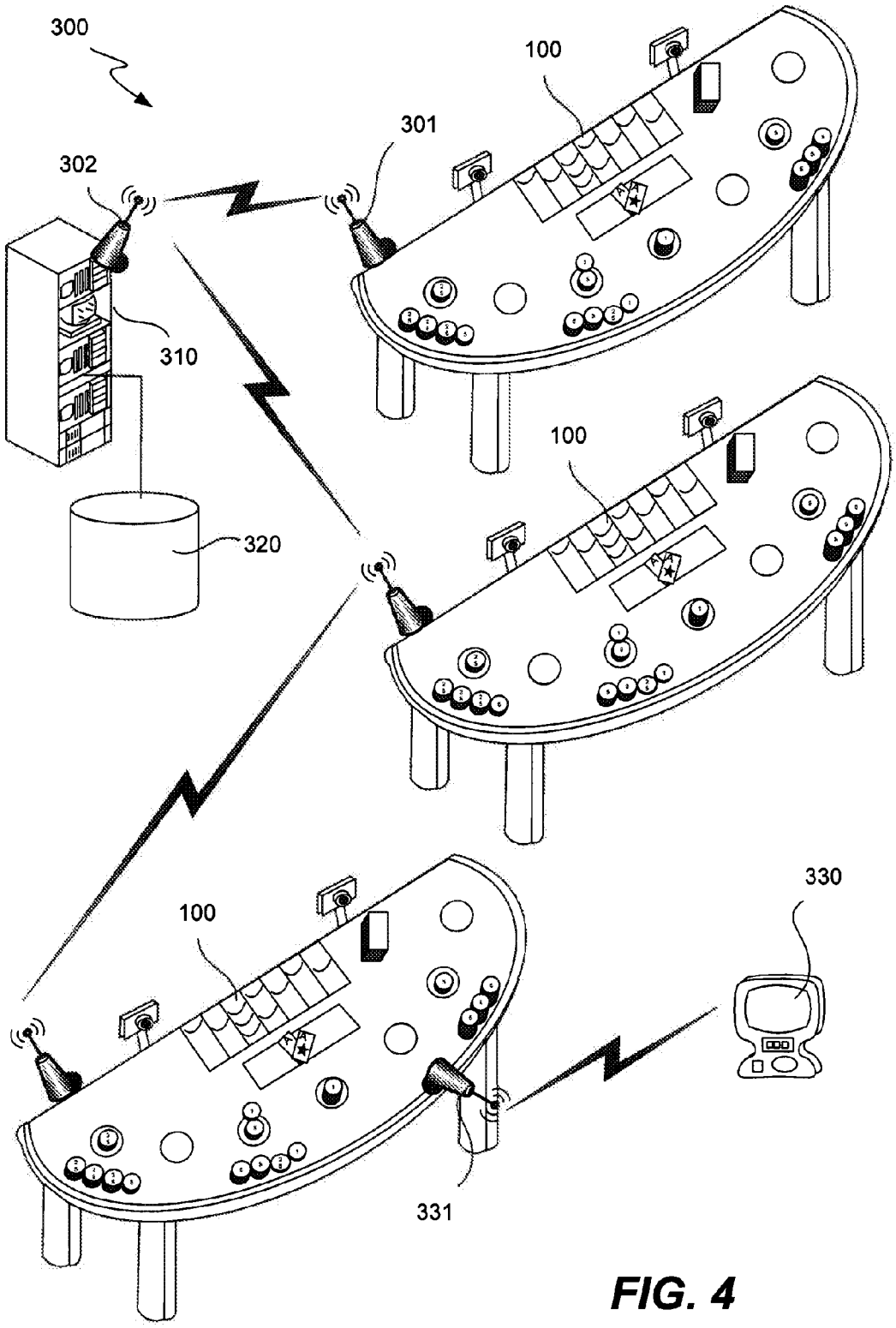
FIG. 4 illustrates in block diagram format an exemplary network infrastructure adapted to support to a system of interactive gaming tables according to one embodiment of the present invention.

Continuing on to FIG. 4, an exemplary network infrastructure adapted to support to a system of interactive gaming tables according to one embodiment of the present invention is illustrated in block diagram format. Interactive gaming table system or network 300 can include a plurality of interactive gaming tables 100, such as any suitable interactive gaming table embodiment disclosed above. In particular, wireless access interfaces 301 can be provided at each interactive gaming table 100 to accommodate wireless devices and generally permit communications between interactive gaming tables. Such inter-table communications can be used to network gaming tables. It will be understood that while wireless communications may be utilized, such table networking may also be done on a wired basis, such as by connections between tables and a host via wires underneath carpeting and/or other suitable wiring locations.

Interactive gaming table system 300 can include an interactive gaming table host server 310 that can be located remotely from one or more of the member interactive gaming tables 100. Such a host server 310 can be in direct or indirect communication with each of the interactive gaming tables, and may be adapted to synchronize coordinated gaming activities for and between tables. For example, the automated initiation and management of multi-table tournaments, such as blackjack or poker tournaments, can be facilitated through the use of host server 310. In addition, host server 310 can be utilized for player tracking, game tracking and game auditing purposes. Accordingly, a system database may be in communication with and controlled by host server 310. Further, a host server, such as 310, may be utilized to provide shared video content that may be generated in response to detecting one object in a group of objects that trigger a display of the shared content as was previously described with respect to FIG. 1B.

Various programmable items can be administered from host server 310 and/or associated database 320. Such programmable items can be retrieved from database 320, downloaded from host server 310 to one or more interactive gaming tables 310, and can substantially resemble the types of server based gaming that are becoming available for gaming machines. For example, various gaming table layouts for interactive gaming tables having a full LCD or other display playing surface 120 can be stored at host server 310 and/or database 320 and then sent to individual gaming tables for use at those gaming tables. In systems having such capabilities, one or more casino personnel may choose to change all blackjack tables at one area of a pit or casino floor to pai-gow poker or Let It Ride tables. A simple input or command to the host server 310 could then result in the displayed layout at the desired tables being changed from blackjack to the new format.

In further embodiments, such reconfiguration of tables may be automated to some degree. For example, where system software is adapted to make changes at given times or for other triggering factors, such changes to gaming table layouts can be made automatically. Such triggering factors might also include, for example, outputs from automated tracking software adapted to analyze casino floor trends, such that the right numbers, types and denominations of tables are present on the casino floor at any given time, with little to no manual intervention needed on the part of casino personnel or management.

At least one wireless access interface 301 at each interactive gaming table can be adapted such that inter-table communications are possible. Communications from wireless access interface 301 might also be made between interactive gaming table 100 and host server 310. Accordingly, host server 310 might also have its own wireless access interface 302 for such communications. Where inter-table communications are enabled, such as between access interfaces from table to table, it may be unnecessary from host server 310 to communicate directly with each and every interactive gaming table 100 in the network or system. Rather, host server 310 might be made to communicate with one table or some subset of tables, so long as communications could then be relayed along from table to table such that most or all tables can receive communications from the host server indirectly. In lieu of having even one wireless connection from a host server to an interactive gaming table, one or more wired connections may also be provided. As still another alternative, host server 310 may have a wired connection to a standalone wired-to-wireless access point (not shown), from which wireless connections may then be made to one or more interactive gaming tables 100, as shown.

In various embodiments, one or more auxiliary devices 330 adapted to accept player input may be provided. Such player controlled auxiliary devices can be wireless handheld devices, and details for such a handheld device can be found at, for example, U.S. Pat. No. 6,628,939 entitled "Personal Gaming Device," which reference is incorporated herein by reference and for all purposes. While wireless handheld devices and communications may be utilized, it is also contemplated that such a handheld device also be made available via wired connections, such as by a coiled cord, to prevent players from walking away from an interactive gaming table with such a handheld device. Player input on such a handheld device might be input regarding gaming activities at an interactive gaming tables, such as game play information or input.

Wireless connections between such an auxiliary device 330 and a given interactive gaming table 100 might be made via wireless access interface 301 and/or one or more additional wireless access interfaces 331 at the table. As noted above, such additional wireless access interfaces may be placed at specific player and/or dealer positions or stations, such that a player using a handheld wireless auxiliary device 330 might be able to participate in a wager-based table game at the interactive gaming table 100. In some embodiments, more than one wireless access interface may be provided per single player station. Of course, it may be necessary that a player uses such a handheld wireless device when the device is located at or near a respective interactive gaming table, such that adequate reception may be ensured. Alternatively, communications may be made over a hard-wired connection between the interactive gaming table 100 and the auxiliary device 330, such as by a tethered and coiled telephone type cord.

Such player participation may be as an active and primary player making the actual main bets and plays at a given player position. Alternatively, a player using an auxiliary device 330 might use such a device to make back betting plays at the interactive gaming table. As is generally known, some forms of table gaming permit players to make back bets or side bets on or with primary players that are playing table games at a gaming table. Such forms of table game play are known to be quite popular within Asian communities and for Asian-based table games, such as pai-gow. As will be generally appreciated, players who are not primary active players at the gaming table, but who may wish to make any back bet, side bet or any other auxiliary bet (i.e., "backbettors"), may be permitted to use an auxiliary device 330 rather than go through the trouble of making conventional manual bets, placements, gestures or actions at an interactive gaming table 100. As will be readily appreciated, many backbettors may be permitted to make wagers or conduct other gaming activities with respect to a single active player or dealer, such as via multiple wireless access points at a given player position or station. Each backbettor may have his or her own handheld device, with each such device being adapted to communicate with the interactive gaming table via one or more access interfaces 331, which may be adapted for wireless communications. In some embodiments, there may be a one-to-one correspondence between auxiliary device 330 and access interface 331.

Methods of Use

Figure 5:
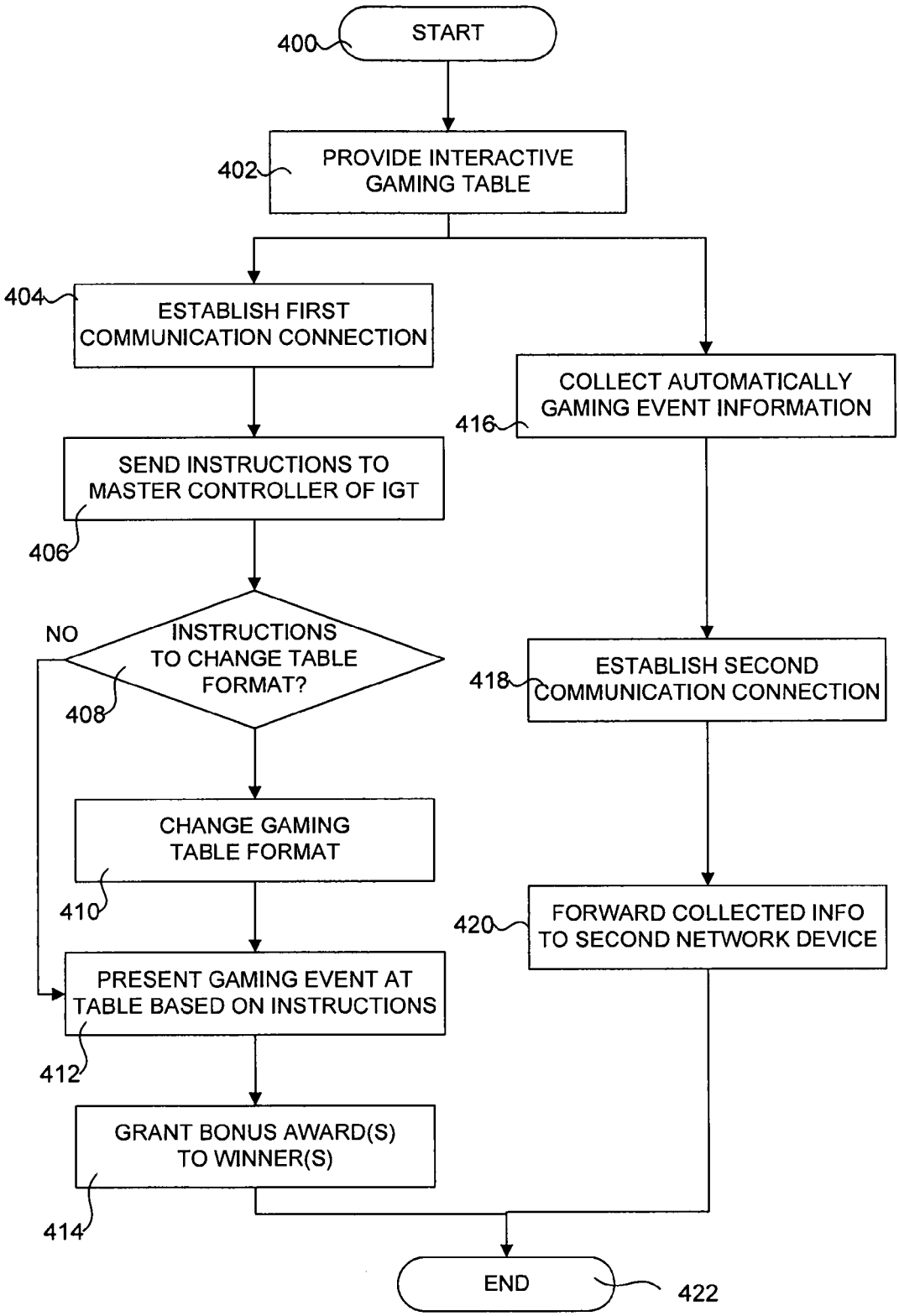
FIG. 5 illustrates a flowchart of an exemplary method of providing a gaming event across a plurality of networked interactive gaming tables according to one embodiment of the present invention.

Turning to FIG. 5, a flowchart conveying an exemplary method of providing a gaming event across a plurality of networked interactive gaming tables according to one embodiment of the present invention is shown. While this flowchart may be comprehensive in some respects, it will be readily understood that not every step provided is necessary, that other steps can be included, and that the order of steps might be rearranged as desired by a given gaming operator. After start step 400, a first interactive gaming table is provided at a process step 402. While such an interactive gaming table can be substantially similar to those embodiments set forth above for interactive gaming table 100, it will also be understood that any suitable gaming table or other gaming venue similarly equipped and suited for the various peripherals and functionalities herein may also be provided.

At subsequent process step 404, a first communication connection is established between an access interface at the provided interactive gaming table and a first networked device. As noted above, such a networked device may be external and/or remote to the first interactive gaming table, and may be another interactive gaming table, a host server, a handheld device, or some other network component. At method step 406, instructions are then sent to the master gaming table controller of the interactive gaming table from the first networked device. Such instructions can be of a variety of types, such as, for example, instructions to play a particular type of table game, to coordinate games between tables, such as for a multi-table tournament, to facilitate player tracking or game auditing, to download and/or install or change various table items, such as a table surface layout, among other various possibilities.

The interactive gaming table may act on such instructions immediately or at some later time. As one example, such instructions could be to change a gaming table layout at the playing surface of the interactive gaming table. As such, a decision step 408 might need to be resolved as to whether the display atop the gaming table surface is to be changed from a first gaming format to a second gaming format. If such an instruction is to change table formats, then the method proceeds to step 410, where such a format may be changed.

The format may be changed in response to detecting one or more physical objects of the table. For example, when one type of physical object is detected, such as a maintenance object is detected, then the machine may formatted into a diagnostic mode that allows diagnostic information to be obtained from the table. In another embodiment, a regulator object may be detected that may places the interactive gaming table in a format for providing information to regulator.

In other embodiments, a format of table may be altered in response to detecting a presence of a group of physical objects present at a table. A play of a particular game may utilize a particular set of physical objects. These physical objects may be utilized by an operator, a player or combinations thereof. For example, a dealer may place 3 objects on the surface of the interactive gaming table that are associated with the play of a particular card game, when the table detects the presence of the these 3 object then the table may be formatted to the play of the game associated with the 3 objects then the interactive gaming table may generate one or more video images associated with the play of the game. When less than the required objects are detected, the interactive gaming table may not change its format, such as when 2 of the 3 objects were detected.

In general, one or more video display windows may be triggered in response to a detection of a group of objects. For instance, a video display window for a bonus game may be triggered when the interactive gaming table detects the presence of two or more physical objects associated with the bonus game. In this example, only one the physical objects may be placed by a single player at a time or a single player may place one or more of the physical objects that may be needed to trigger the bonus. For example, in certain instances a player may be awarded a physical object that triggers a certain function at the interactive gaming table. One or more of the objects may need to be detected by the interactive gaming table before the function associated with the physical objects is triggered.

In any event, the method can then continue to a process step 412 to present a gaming event at the interactive gaming table based at least in part on the sent instructions. For example, where the instructions involved a command to change the gaming table layout from a blackjack table to a pai-gow poker table, a later presentation of a pai-gow game at the interactive gaming table would then comprise such a process step 412. After process step 412, a monetary payout or other prize is awarded to an active player at the interactive gaming table based on the presented gaming event at process step 414.

The provided method can also includes a process step 416 for collecting automatically game event information from the play of one or more table games at the interactive gaming table, after which a following process step 418 can involve establishing a second communication connection between an access interface at the table and a second networked device. Method step 420 then involves the forwarding of the game event information to the second networked device, which again could be a host server, another interactive gaming table, or some other external device. As noted above, such communications may be wireless or may also be wired. As also noted above, such communications may involve instructions sent from a host server, which instructions may be sent directly to the first interactive gaming table, or may be sent directly to a second interactive gaming table, which then relays the instructions to the first interactive gaming table. In the event that the first networked device is a player controlled auxiliary device, such instructions could involve a backbet command or data sent from a player backbetting with the auxiliary device.

After step 420, the method ends at end step 422. Again, various details and additional steps may similarly be included, and it is specifically contemplated that many variations of these exemplary methods may also be practiced. For example, as will be appreciated, many of the foregoing process steps may be grouped together in various ways. Because it may not be particularly important which order these various groups are performed in, these steps or groups are shown as being performed in parallel in FIG. 5. Other variations may also be used as desired by a particular gaming operator.

Figure 6:
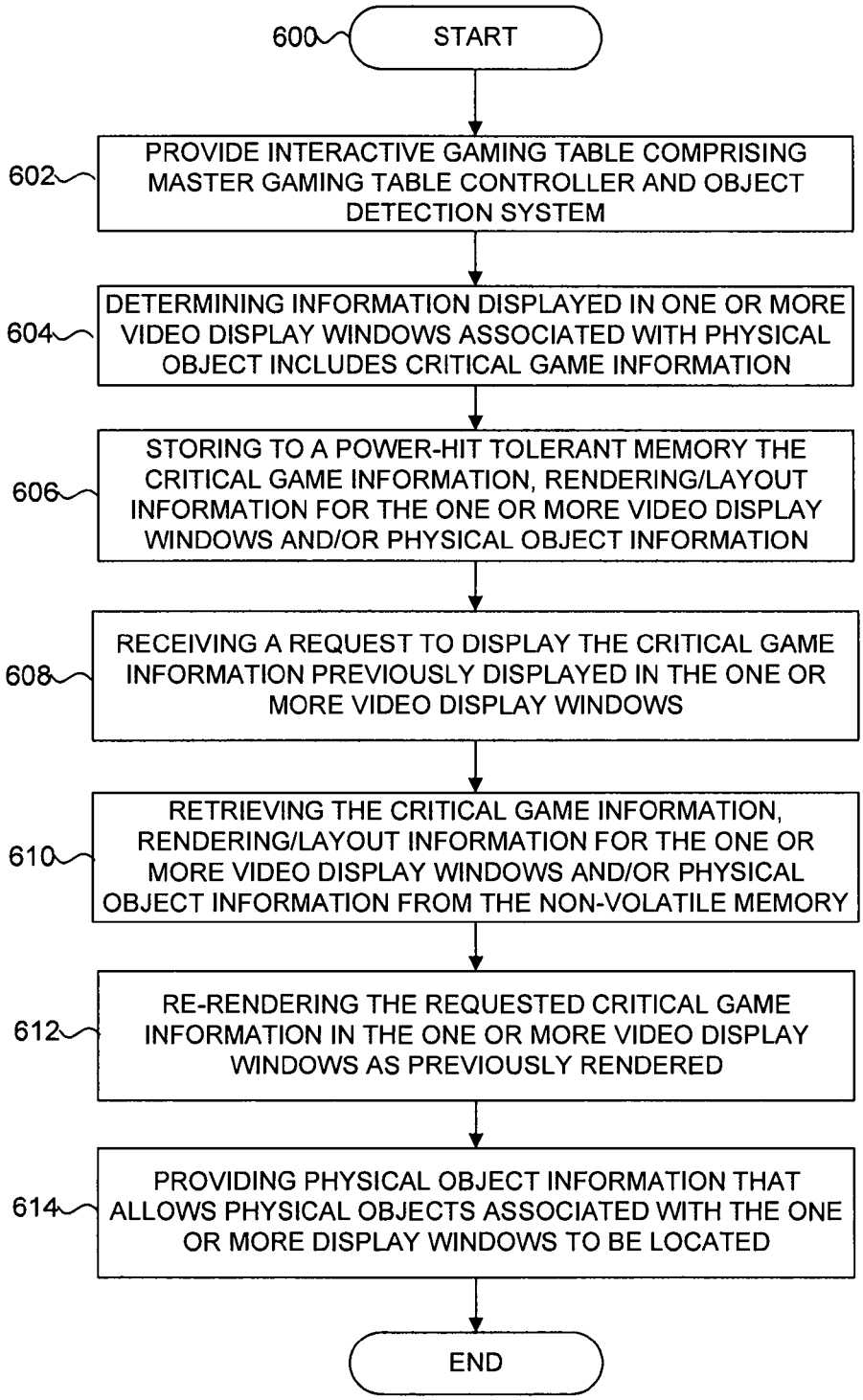
FIG. 6 illustrates a flowchart of an exemplary method of storing and retrieving a game history record for one embodiment of the present invention.

FIG. 6 illustrates a flowchart of an exemplary method of storing and retrieving a game history record for one embodiment of the present invention. In 602, an interactive gaming table, as previously described above, comprising master a gaming table controller, at least one video display area and an object detection system with coordinated object detection and video display capabilities may be provided. A physical object may be placed on the interactive table and in response a video display window for displaying video images may be generated in the video display area of the interactive gaming table as was described at least with respect to FIGS. 1A, 1B and 1C. For example, in response to detecting one or more card shaped objects placed on the table, the interactive gaming table may have generated images of playing cards at the locations of the one or more card shaped objects. The position and orientation of the physical object may be variable and depend where an operator or a player may have placed it in the video display area.

In 604, it may be determined that information displayed in one or more video display windows associated with physical object includes critical game information. For example, after receiving a wager, a card that is part of a play of wager-based game generated at the interactive gaming table may be displayed in one of the video display windows. The card may have been randomly selected by the master table gaming controller and the choice of card may affect an outcome to the wager-based game played at the interactive gaming table. Other examples of critical game information may include but are not limited to wager information or award information.

In 606, when it is determined that critical game information is to be displayed in one of the video display windows, prior to advancing to a next state in the play of the game, the master table gaming controller may be operable to store to a power-hit tolerant memory the critical game information, rendering/layout information for the one or more video display windows and/or physical object information. One example of a format of information that may be stored to a power-hit tolerant memory may be a screen capture of video frame data rendered in the video display window. Another example of a format of information may be textual data and related graphical rendering information that may be used to recreate video images rendered in the video display window. Details related to capturing frame data and recreating a record of a game history that may be utilized are described in U.S. Pat. No. 6,863,608, filed Oct. 11, 200 and entitled "Frame Capture of Actual Game Play," which is incorporated herein and for all purposes.

A power-hit tolerant memory is typically a non-volatile memory. However, not all non-volatile memories necessary may be utilized as a power-hit tolerant memory. A power-hit tolerant memory requires a write time that is fast enough such that when a power-hit is detected, the master gaming controller is provided enough time to store data to the memory before power is lost. Not all non-volatile memory devices necessarily provide a fast enough write-time. A battery-backed RAM is an example of one type of memory that may be used as power-hit tolerant memory.

In 608, a request to display the critical game information previously displayed in the one more video display windows may be received at the interactive game table. For instance, an operator at the interactive game table may be provided a menu and an input mechanism, such as a touch screen, that allows the operator to retrieve from memory critical game information displayed in video display window that may have been viewed through a physical object. As an example, the critical information may be related to a past table game played on the interactive gaming table, such as a card hand initially dealt to a player or a card hand that a player had at a certain point in a play of a game.

In response to receiving a request for specified information, the interactive gaming table may be operable to, in 610, to retrieve he critical game information, rendering/layout information for the one or more video display windows and/or physical object information from a non-volatile memory. The non-volatile memory may be the power-hit tolerant memory or another non-volatile memory from which data originally stored in the power-hit tolerant memory was stored. In 612, the interactive gaming table may be operable to re-render the requested critical game information in the one or more video display windows similar to what was previously rendered using graphical information and other data previously stored. In another embodiment, the video frame data may have been previously stored and may be redisplayed to a video display.

The re-rendering may not be identical to what was originally rendered as long it is a convincing representation of what was previously displayed. The re-rendering may be at a position in the video display area where it was originally rendered. The position or location where critical game information may change from game to game as physical objects that are used to position a location of video display windows associated with critical game information are moved from game to game by an operator or by a player. In 614, physical object information that allows physical objects associated with the one or more display windows may be provided to allow a particular physical object associated with the display window where the critical game information was displayed to be positioned at its location when the critical information was previously displayed in the video display window. In the instance where the critical information is game information, the positioning data for the physical object may allow a layout of the game including the positioning of the physical object to be re-created for a player, which may be more convincing to a player wishing to review a previous game state of a game played on the interactive game table.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A method comprising:

causing a master gaming table controller to execute a plurality of instructions to initiate for at least a first active player, a wager-based game at an interactive gaming table, said game involving granting monetary awards based on results of the wager-based game, said interactive gaming table including: 1) a first surface adapted for a play of the wager-based game wherein the interactive gaming table is operable to enable one or more active players to play the wager-based game on the first surface, 2) a plurality of video display areas on the first surface wherein at least one video display area is associated with each active player, 3) an object detection system operable to acquire information regarding at least one of a position, a shape, an orientation, and combinations thereof for one or more physical objects placed on the first surface, and 4) a memory storing information regarding the one or more physical objects;

causing the master gaming table controller to execute the plurality of instructions to receive information from the object detection system indicating that a first physical object is located in the at least one video display area associated with the first active player, wherein the first physical object includes a transparent portion configured as a video display window that enables information generated in the at least one video display area on the first surface of the gaming table to be viewed through the transparent portion;

causing the master gaming table controller to execute the plurality of instructions to determine one or more of a position, a shape, and an orientation of the video display window of the first physical object;

causing the master gaming table controller to execute the plurality of instructions to determine an identity of the first active player;

causing the master gaming table controller to execute the plurality of instructions to operate with the at least one video display area associated with the first active player to control a display of first video images in the video display window configured for viewing by the first active player, wherein the first video images are at least partly customized to the determined identity of the first active player; and causing the master gaming table controller to execute the plurality of instructions to operate with the at least one video display area associated with the first active player to control a display, in the at least one video display area associated with the first active player outside of the video display window, of second video images, including information related to the play of the wager-based game;

wherein, the master gaming table controller is configured to dynamically alter a content of the first video images, responsive to an input from the first active player.

2. The method of claim 1, further comprising: causing the master gaming table controller to execute the plurality of instructions to operate with the display device to determine that the first physical object is associated with a type of interface and provide video images associated with the type of interface in the first video display window.

3. The method of claim 2, wherein the type of interface is one of a player tracking interface, a cashless gaming interface or a game playing interface.

4. The method of claim 1, further comprising causing the master gaming table controller to execute the plurality of instructions to operate with the at least one video display area to display one or more game objects in the first video display area.

5. The method of claim 1, further comprising causing the master gaming table controller to execute the plurality of instructions to operate with the at least one video display area to display video images of one or more game objects used to play the wager-based table game in the first video display window.

6. The method of claim 5, wherein the one or more game objects are one or more of a chip, a marker, a die, a playing card or a marked tile.

7. The method of claim 1, wherein, when placed on the first surface, a footprint of the first physical object on the first surface is one of a rectangular shaped or a circular shaped.

8. The method of claim 1, wherein the identity of the first active player is determined using information obtained from the first physical object.

9. The method of claim 1, further comprising:

causing the master gaming table controller to execute the plurality of instructions to determine the information displayed in the first video display window includes critical game information;

causing the master gaming table controller to execute the plurality of instructions to store to a power-hit tolerant non-volatile memory the critical game information;

causing the master gaming table controller to execute the plurality of instructions to store the position, the shape, the orientation or the combinations thereof of the first video display window in which the critical game information is displayed;

causing the master gaming table controller to execute the plurality of instructions to operate with at least one input device to receive a request to display the critical game information previously displayed in the first video display window;

causing the master gaming table controller to execute the plurality of instructions to retrieve from the power-hit tolerant non-volatile memory the critical game information and the position, the shape, the orientation or the combinations thereof of the first video display window;

causing the master gaming table controller to execute the plurality of instructions to generate the position, the shape, the orientation or the combinations thereof of the first video display window in which the critical game information was previously displayed first display window in the position; and causing the master gaming table controller to execute the plurality of instructions to operate with the at least one video display area to control the display of the critical game information in the first video display window.

10. The method of claim 1, further comprising:

causing the master gaming table controller to execute the plurality of instructions to provide the first physical object wherein the first physical object includes a first display;

causing the master gaming table controller to execute the plurality of instructions to select information to display to the first active player;

causing the master gaming table controller to execute the plurality of instructions to operate with the at least one video display area to generate video images including the information selected for the first active player in the first video display window;

causing the master gaming table controller to execute the plurality of instructions to send from the master gaming table controller to the first physical object the information selected for first active player to enable the information selected for the first active player to be displayed at the same time on the first display and the first video display window.

11. The method of claim 10, wherein the information selected for the first active player is an award, promotional credits or an offer.

12. The method of claim 1, wherein the first physical object includes a first display.

13. The method of claim 1, wherein the transparent portion of the first physical object includes a dynamically adjustable display.

14. The method of claim 1, wherein light-transmissive properties of the first physical object are dynamically adjustable.

15. The method of claim 14, further comprising:

causing the master gaming table controller to execute the plurality of instructions to send to the first physical object a command for the first physical object to adjust its light-transmissive properties.

16. The method of claim 1, further comprising:

causing the master gaming table controller to execute the plurality of instructions to operate with the at least one video display area and at least one input device to control a display of first video images including a touch activated button in the first display window that is viewable through the transparent portion of the first physical object;

causing the master gaming table controller to execute the plurality of instructions to operate with the at least one input device to receive information indicating a selection of the touch activated button; and in response to the selection of touch activated button, causing the master gaming table controller to execute the plurality of instructions to control a display of second video images.

17. The method of claim 1, wherein the first physical object includes a first transparent portion and a second transparent portion and further comprising: causing the master gaming table controller to execute the plurality of instructions to operate with the at least one video display area to control a display of first video images visible through the first transparent portion and a display of second video images visible through the second transparent portion.

18. The method of claim 1, further comprising:

causing the master gaming table controller to execute the plurality of instructions to determine the first physical object is not located within an acceptable area of the first video display area;

causing the master gaming table controller to execute the plurality of instructions to operate with the at least one video display area to control a display of video images in the first video display area to indicate the first physical object is not within the acceptable area;

causing the master gaming table controller to execute the plurality of instructions to halt the play of the wager-based game;

causing the master gaming table controller to execute the plurality of instructions to determine the first physical object is within the acceptable area of the first video display area; and causing the master gaming table controller to execute the plurality of instructions to continue the play of the wager-based game.

19. The method of claim 1, further comprising:

during the play of the wager-based game, causing the master gaming table controller to execute the plurality of instructions to operate with the at least one video display area to determine one of a second position and a second orientation of the transparent portion of the first physical object in the first video display area;

causing the master gaming table controller to execute the plurality of instructions to operate with the at least one video display area to determine one of a second position and a second orientation of the first video display window in the first video display area to enable information generated in the first video display window to be viewable through the transparent portion of the first physical object.

20. The method of claim 1, further comprising:

causing the master gaming table controller to execute the plurality of instructions to determine a first orientation of the first video images to be displayed in the first video display window.

* * * * *

UNITED STATES PATENT AND TRADEMARK OFFICE

CERTIFICATE OF CORRECTION

PATENT NO. : 8,905,834 B2
APPLICATION NO. : 11/938179
DATED : December 9, 2014
INVENTOR(S) : William R. Wells It is certified that error appears in the above-identified patent and that said Letters Patent is hereby corrected as shown below:

IN THE CLAIMS

In Claim 1, Column 34, Line 1, between "said" and "game" insert --wager-based--.
In Claim 1, Column 34, Line 23, between the first instance of "the" and "gaming" insert --interactive--.
In Claim 2, Column 34, Line 53, replace "the" with --a--.
In Claim 2, Column 34, Line 56, delete "first".
In Claim 3, Column 34, Line 59, replace "or" with --and--.
In Claim 4, Column 34, Line 63, replace "first" with --at least one--.
In Claim 5, Column 35, Line 2, delete "table".
In Claim 5, Column 35, Line 2, delete "first".
In Claim 6, Column 35, Line 6, replace "or" with --and--.
In Claim 7, Column 35, Line 9, replace "or" with --and--.
In Claim 9, Column 35, Line 16, delete "first".
In Claim 9, Column 35, Line 24, delete "first".
In Claim 9, Column 35, Line 30, delete "first".
In Claim 9, Column 35, Line 36, delete "first".
In Claim 9, Column 35, Line 41, delete "first".
In Claim 9, Column 35, Lines 42 to 43, delete "first display win-dow in the position".
In Claim 9, Column 35, Line 47, delete "first".
In Claim 10, Column 35, Line 60, delete "first".
In Claim 10, Column 35, Line 60, after ";" insert --and--.
In Claim 10, Column 35, Line 64, between "for" and "first" insert --the--.
In Claim 10, Column 35, Line 66, delete "first".
In Claim 11, Column 36, Line 2, between "," and "promotional" insert --a--.
In Claim 16, Column 36, Line 22, replace "first" with --video--.
In Claim 18, Column 36, Line 44, replace "first" with --at least one--.
In Claim 18, Column 36, Line 49, replace the first instance of "first" with --at least one--.
In Claim 18, Column 36, Line 56, replace "first" with --at least one--.

Signed and Sealed this
Twenty-sixth Day of April, 2016

Michelle K. Lee

Michelle K. Lee
*Director of the United States Patent and Trademark Office*

IN THE CLAIMS

In Claim 19, Column 36, Line 67, replace “first” with --at least one--.
In Claim 19, Column 36, Line 67, after “;” insert --and--.
In Claim 19, Column 37, Line 4, delete “first”.
In Claim 19, Column 37, Line 5, replace “first” with --at least one--.
In Claim 19, Column 37, Line 6, delete “first”.
In Claim 20, Column 37, Line 12, delete the second instance of “first”.